US010385567B2

(12) United States Patent
Parkes et al.

(10) Patent No.: US 10,385,567 B2
(45) Date of Patent: Aug. 20, 2019

(54) JOINT EDGE ASSEMBLY AND METHOD FOR FORMING JOINT IN OFFSET POSITION

(71) Applicant: Illinois Tool Works, Inc., Glenview, IL (US)

(72) Inventors: Nigel K. Parkes, Atlanta, GA (US); Robert Urquhart Connell, Melbourne (AU)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/131,610

(22) Filed: Sep. 14, 2018

(65) Prior Publication Data

US 2019/0017266 A1 Jan. 17, 2019

Related U.S. Application Data

(63) Continuation of application No. 15/270,784, filed on Sep. 20, 2016, now Pat. No. 10,077,551.

(Continued)

(51) Int. Cl.

*E04B 5/32* (2006.01)
*E04B 1/48* (2006.01)

(Continued)

(52) U.S. Cl.

CPC ..... *E04B 5/32* (2013.01); *E01C 11/14* (2013.01); *E04B 1/483* (2013.01); *E04F 15/14* (2013.01);

(Continued)

(58) Field of Classification Search

CPC ..... E04B 5/32; E04B 1/483; E04B 2005/322; E04B 2103/06; E04B 2103/02;

(Continued)

(56) References Cited

U.S. PATENT DOCUMENTS 602,769 A 4/1898 Parker
811,560 A 2/1906 Hinchman (Continued)

FOREIGN PATENT DOCUMENTS

AT 348222 6/1978
AU 2013202091 10/2013

(Continued)

OTHER PUBLICATIONS

American Concrete Pavement Association, "Design and Construction of Joints for Concrete Highways" (1991) (16 Pages).

(Continued)

*Primary Examiner* — Adriana Figueroa
*Assistant Examiner* — Jessie T Fonesca
(74) *Attorney, Agent, or Firm* — Neal, Gerber & Eisenberg LLP

(57) ABSTRACT

Various embodiments of the present disclosure provide a joint edge assembly and method of positioning and installing joint edge assembly for adjacent concrete slabs. The method includes positioning the joint edge assembly in an offset position from the joint. The method of various embodiments also includes using a plurality of height adjusters or plates fixed to the slab engagement surface of the one of the joint edge members to adjust or assist in adjusting the height of the joint edge assembly relative to the formwork and relative to the plane of the top surfaces of the concrete slabs.

20 Claims, 25 Drawing Sheets

Related U.S. Application Data

(60) Provisional application No. 62/349,926, filed on Jun. 14, 2016, provisional application No. 62/237,295, filed on Oct. 5, 2015.

(51) Int. Cl.
*E01C 11/14* (2006.01)
*E04F 15/14* (2006.01)

(52) U.S. Cl.
CPC ... *E04B 2005/322* (2013.01); *E04B 2005/324* (2013.01); *E04B 2103/02* (2013.01); *E04B 2103/06* (2013.01); *E04F 15/142* (2013.01)

(58) Field of Classification Search
CPC .... E04B 2005/324; E01C 11/14; E01C 11/08; E01C 11/126; E01C 11/106; E04F 15/142; E04F 15/14; Y10T 29/49632
See application file for complete search history.

(56) References Cited

U.S. PATENT DOCUMENTS

| | | | |
|---|---|---|---|
| 828,550 | A | 8/1906 | Inman et al. |
| 881,762 | A | 3/1908 | Adreon, Jr. |
| 920,808 | A | 5/1909 | Alcott |
| 1,298,018 | A | 3/1919 | Davis |
| 1,557,165 | A | 10/1925 | Hooper |
| 1,632,395 | A | 6/1927 | Fellows |
| 1,753,316 | A | 4/1930 | Robertson |
| 1,894,395 | A | 1/1933 | Burrell |
| 1,956,046 | A | 4/1934 | Robertson |
| 2,064,528 | A | 12/1936 | Fischer |
| 2,103,337 | A | 12/1937 | Oury |
| 2,121,303 | A | 6/1938 | Robertson |
| 2,149,467 | A | 3/1939 | Robertson |
| 2,167,904 | A | 8/1939 | Older |
| 2,179,911 | A | 11/1939 | Wilmoth |
| 2,181,005 | A | 11/1939 | Westcott |
| 2,193,129 | A | 3/1940 | Geyer et al. |
| 2,201,134 | A | 5/1940 | Brickman et al. |
| 2,207,168 | A | 7/1940 | Thomas et al. |
| 2,210,356 | A | 8/1940 | Bauer |
| RE21,996 | E | 1/1942 | Oates |
| 2,308,677 | A | 1/1943 | Dailey |
| 2,309,538 | A | 1/1943 | Robertson |
| 2,316,233 | A | 4/1943 | Fischer |
| 2,319,972 | A | 5/1943 | Brickman |
| 2,349,983 | A | 5/1944 | Musall |
| 2,416,584 | A | 2/1947 | Heltzel |
| 2,441,903 | A | 5/1948 | Robertson |
| 2,489,851 | A | 11/1949 | Bean |
| 2,509,180 | A | 5/1950 | Yeoman |
| 2,531,040 | A | 11/1950 | Heltzel |
| 2,589,815 | A | 3/1952 | Jacobson |
| 2,636,426 | A | 4/1953 | Heltzel |
| 2,654,297 | A | 10/1953 | Nettleton |
| 2,745,165 | A | 5/1956 | Lewis |
| 2,775,924 | A | 1/1957 | Brickman |
| 2,780,149 | A | 2/1957 | Heltzel |
| 3,104,600 | A | 9/1963 | White |
| 3,246,433 | A | 4/1966 | Eriksson |
| 3,372,521 | A | 3/1968 | Thom |
| 3,430,406 | A | 3/1969 | Weber |
| 3,434,263 | A | 3/1969 | Beckman et al. |
| 3,527,009 | A | 9/1970 | Nyquist |
| 3,559,541 | A | 2/1971 | Watstein |
| 3,561,185 | A | 2/1971 | Finsterwalder et al. |
| 3,745,726 | A | 7/1973 | Thom |
| 3,855,754 | A | 12/1974 | Scoville et al. |
| 3,951,562 | A | 4/1976 | Fyfe |
| 3,964,219 | A | 6/1976 | Hala |
| 4,021,984 | A | 5/1977 | Honegger |
| 4,091,589 | A | 5/1978 | Moot |
| 4,257,207 | A | 3/1981 | Davis |
| 4,353,666 | A | 10/1982 | Brandley |
| 4,373,829 | A | 2/1983 | Braxell |
| 4,453,360 | A | 6/1984 | Barenberg |
| 4,548,009 | A | 10/1985 | Dahowski |
| 4,733,513 | A | 3/1988 | Schrader et al. |
| 4,804,292 | A | 2/1989 | DeLuca |
| 4,883,385 | A | 11/1989 | Kaler |
| 4,904,111 | A | 2/1990 | Weisbach |
| 4,996,816 | A | 3/1991 | Wiebe |
| 5,005,331 | A | 4/1991 | Shaw et al. |
| 5,216,862 | A | 6/1993 | Shaw et al. |
| 5,261,635 | A | 11/1993 | Flathau |
| 5,337,534 | A | 8/1994 | Nasca |
| 5,366,319 | A | 11/1994 | Hu et al. |
| 5,419,057 | A | 5/1995 | Jackson |
| 5,419,965 | A | 5/1995 | Hampson |
| 5,458,433 | A | 10/1995 | Stastny |
| 5,487,249 | A | 1/1996 | Shaw et al. |
| 5,674,028 | A | 10/1997 | Norin |
| 5,713,174 | A | 2/1998 | Kramer |
| 5,730,544 | A | 3/1998 | Dils et al. |
| 5,797,231 | A | 8/1998 | Kramer |
| 5,934,821 | A | 8/1999 | Shaw et al. |
| 5,941,045 | A | 8/1999 | Plehanoff et al. |
| 6,019,546 | A | 2/2000 | Ruiz |
| 6,052,964 | A | 4/2000 | Ferm et al. |
| 6,145,262 | A | 11/2000 | Schrader et al. |
| 6,195,956 | B1 | 3/2001 | Reyneveld |
| 6,354,053 | B1 | 3/2002 | Kerrels |
| 6,354,760 | B1 | 3/2002 | Boxall et al. |
| 6,471,441 | B1 | 10/2002 | Müller |
| 6,502,359 | B1 | 1/2003 | Rambo |
| 6,532,714 | B1 | 3/2003 | Ferm et al. |
| 6,775,952 | B2 | 8/2004 | Boxall et al. |
| 6,874,288 | B1 | 4/2005 | Washa et al. |
| 6,926,463 | B2 | 8/2005 | Shaw et al. |
| 7,004,443 | B2 | 2/2006 | Bennett |
| 7,201,535 | B2 | 4/2007 | Kramer |
| 7,228,666 | B2 | 6/2007 | Michiels |
| 7,338,230 | B2 | 3/2008 | Shaw et al. |
| 7,441,985 | B2 | 10/2008 | Kelly et al. |
| 7,481,031 | B2 | 1/2009 | Boxall et al. |
| 7,716,890 | B2 | 5/2010 | Boxall et al. |
| 7,736,088 | B2 | 6/2010 | Boxall et al. |
| 8,302,359 | B2 | 11/2012 | Boxall et al. |
| 8,303,210 | B2 | 11/2012 | Parkes et al. |
| 8,381,470 | B2 | 2/2013 | Boxall et al. |
| 9,458,638 | B2 | 10/2016 | Parkes et al. |
| 2003/0033778 | A1 | 2/2003 | Boxall et al. |
| 2006/0177267 | A1 | 8/2006 | Carroll |
| 2007/0231068 | A1 | 10/2007 | Francies et al. |
| 2008/0222984 | A1 | 9/2008 | Michiels |
| 2015/0016870 | A1 | 1/2015 | Arnold |

FOREIGN PATENT DOCUMENTS

| | | |
|---|---|---|
| BE | 1015453 | 4/2005 |
| CH | 594106 | 12/1977 |
| DE | 152821 | 7/1904 |
| DE | 726829 | 10/1942 |
| DE | 894706 | 10/1953 |
| DE | 3424362 | 1/1986 |
| DE | 3440828 | 5/1986 |
| DE | 3808148 | 9/1989 |
| EP | 0032105 | 7/1981 |
| EP | 0059171 | 9/1982 |
| EP | 0328484 | 8/1989 |
| EP | 0410079 | 1/1991 |
| EP | 1389648 | 2/2004 |
| FR | 2785632 | 5/2000 |
| GB | 2285641 | 7/1995 |
| GB | 2500626 | 10/2013 |
| GB | 2507071 | 4/2014 |
| GB | 2511729 | 7/2014 |
| GB | 2530344 | 3/2016 |
| WO | WO9639564 | 12/1996 |
| WO | WO9931329 | 6/1999 |
| WO | WO2004065694 | 8/2004 |
| WO | WO2013/076500 | 5/2013 |

(56) References Cited

FOREIGN PATENT DOCUMENTS

| | | | |
|---|---|---|---|
| WO | WO-2013072619 A1 * | 5/2013 | ..... E01C 11/14 |
| WO | WO2014/060752 | 4/2014 | |
| WO | WO2014/111712 | 7/2014 | |
| WO | WO 2015/121538 | 8/2015 | |

OTHER PUBLICATIONS

American Concrete Pavement Association, "Design and Construction of Joints for Concrete Streets", (1992) (11 Pages).
American Concrete Institute, ACI Committee 302, "Guide for Concrete Floor and Slab Construction", ACI 302.1R-96 (1997) (17 Pages).
Laser Form pamphlet entitled: "Who's going to use Laser Form first? You or your competition?" (Available Prior to Oct. 15, 2015) (6 Pages).
PNA Construction Technologies, "PNA Square Dowel Basket Isometric," Current, Sheet SDB-1, Jun. 2004, Atlanta, GA (1 Page).
ACI Committee 360, "Design of Slabs-on-Ground, ACI 260R-06," Aug. 9, 2006 (Page Nos. 360R-1 to 360R-74).
ACI Committee 302, "Guide for Concrete Floor and Slab Construction, ACI 302.1R-04," Mar. 23, 2004 (Page Nos. 302.1R-1 to 302.1R-77).
Wayne W. Walker and Jerry A. Holland, "Performance-Based Dowel Design, Lift-truck design changes require a new look at joint durability," Concrete Construction—The World of Concrete, Jan. 2007 World of Concrete Official Show Issue, Hanley Wood (pp. 1-8).
Nigel Parkes, "A Decade of Dowel Development," L&M Concrete News, Jan. 2007: vol. 7, No. 1 (Page Nos. Cover, 8-10).
Wayne W. Walker and Jerry A. Holland, "Plate Dowels for Slabs on Ground," American Concrete Institute—Concrete International, Jul. 1998 (Page Nos. Cover, 32-38).
Ernest K. Schrader, "A Solution to Cracking and Stresses Caused by Dowels and Tie Bars," American Concrete Institute—Concrete International, Jul. 1991 (6 Pages).
Greg K. Fricks and Nigel K. Parkes, "Innovations for Durable Floors," Concrete Construction, The World of Concrete, Jan. 2002 by Hanley-Wood Publication (4 Pages).
Gregory Scurto, David Scurto, Wayne W. Walker, and Jerry A. Holland, "Cost-Effective Slabs-on-Ground," American Concrete Institute—Concrete International, May 2004 (Page Nos. 65-67).
PNA Construction Technologies, "Square Dowel Baskets," Current, printed from PNA website found under "Products" (Available Prior to Oct. 15, 2015) (1 Page).
PNA Construction Technologies, "PD3 Basket Assembly Instructions for Use," Source: American Concrete Association, R&T Update, "Dowel Basket Tie Wires: Leaving Them Intact Does Not Affect Pavement Performance," Jan. 2005 (1 Page).
PNA Construction Technologies, "PD3 Basket Assembly," Source Material: Concrete Construction, "Performance-Based Dowel Design," Jan. 2007, Wayne Walker and Jerry Holland (1 Page).
PNA Construction Technologies, "PNA PD3 Basket Assembly Isometric," Current, Sheet PD3-1, Aug. 2006, Atlanta, GA (1 Page).
Wayne W. Walker and Jerry A. Holland, Thou Shalt Not Curl Nor Crack . . . (hopefully), Concrete International, Jan. 1999 (7 Pages).
Steve Metzger and Metzger/McGuire, "Handling Joints in Industrial Concrete Floors," World of Concrete 2005, Las Vegas, NV (28 Pages).
Nigel K. Parkes, "Improved Load Transfer and Reduced Joint Spalling Systems for both Construction and Contraction Joints," International Colloquium of Industrial Floors, Jan. 2003, Esslingen, Germany (11 Pages).
Greg K. Fricks and Nigel K. Parks, "Innovations for Durable Floors," Concrete Construction, The World of Concrete, Jan. 2002 by Hanley-Wood Publication (4 Pages).
Nigel Parkes, "Designing the Cost-Effective Slab-on-Ground Least Likely to Crack or Spall," Structure Magazine, Apr. 2007 (Page Nos. 10-12).
Shrader, "A Proposed Solution to Cracking Caused by Dowels," Concrete Construction, Dec. 1987 (2 Pages).
William F. Perenchino, Avoiding Common Mistakes in Concrete Joint Design, Construction Renovation Facilities, reprinted from Plant Engineering, Jan. 11, 1990, Cahners Publishing Company (5 Pages).
William Van Breemen and E. A. Finney, "Design and Construction of Joints in Concrete Pavements," Journal of the American Concrete Institute, Jun. 1950 (pp. 789-819).
Arnold, "Diamond Dowels for Slabs on Ground," Concrete, Jun. 1998 (2 Pages).
E. A. Finney, "Structural Design Considerations for Pavement Joints," Title No. 53-1, part of copyrighted Journal of The American Concrete Institute, V. 28, No. 1, Jul. 1956 (pp. 1-27).
Portland Cement Association, Concrete Floors on Ground, 2d ed. 1983 (41 Pages).
The Concrete Society, Technical Report No. 34: Concrete Industrial Ground Floors, 3d ed., 2003 (8 Pages).
Greenstreak, "Laser Form Job Site Guide" (Available Prior to Oct. 15, 2015) (2 Pages).
Arnold, "Joint Armouring and Load Transfer," Concrete, Sep. 2006 (2 Pages).
Ralph E. Spears, "Concrete Floors on Ground", Portland Cement Association, Second Edition, 1983 (14 Pages).
Guide for Concrete Floor and Slab Construction, Reported by ACI Committee 302, American Concrete Institute (Available Prior to Oct. 15, 2015) (2 Pages).
ACI Committee 306, Technical Manual, 1997 (28 Pages).
Sheet#AE-2, Armor-Edge® n2e Joint Assembly Installation New to Existing Slab—Construction Joints, PNA Construction Technologies, Aug. 2006 (1 page).
Technical Data Sheet: TDS 001-REV2, Armourjoint, www.armourjoint.com (Available Prior to Oct. 15, 2015) (2 Pages).
Isedio Floor Joint Solutions—Armourjoint, Shieldjoint and Steeldeckjoint, www.isedio.com, Mar. 23, 2016 (5 Pages).
European Patent Office as International Searching Authority, International Search Report and Written Opinion for PCT Application No. PCT/US2016/055315 dated Dec. 13, 2016 (10 Pages).
Elstner, Richard C. and Hognestad, Eivind, "Shearing Strength of Reinforced Concrete Slabs," Journal of the American Concrete Institute, V. 28, No. 1, Jul. 1956 (pp. 29-58).
European Patent Office as International Searching Authority, International Search Report and Written Opinion for PCT Application No. PCT/US2017/021360 dated May 22, 2017 (14 pages).
Canadian Office Action for Canadian Application No. 2,996,738, dated Dec. 13, 2018 (7 pages).

* cited by examiner

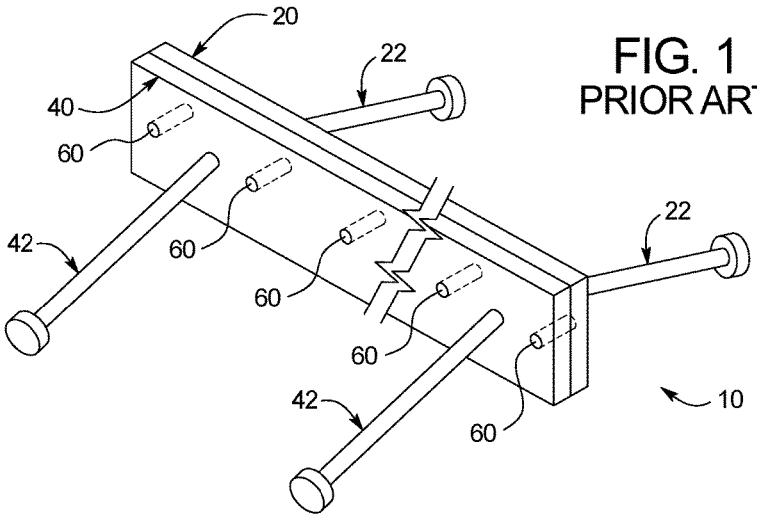
FIG. 1
PRIOR ART
FIG. 2
PRIOR ART
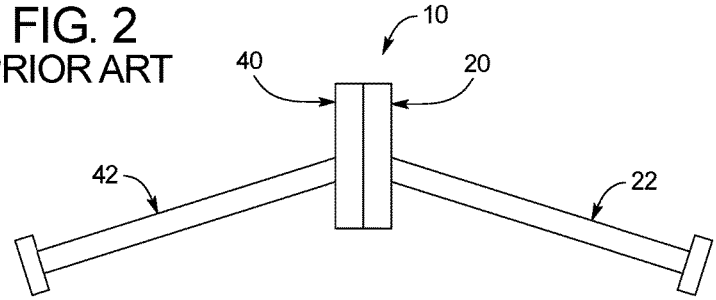
FIG. 3
PRIOR ART
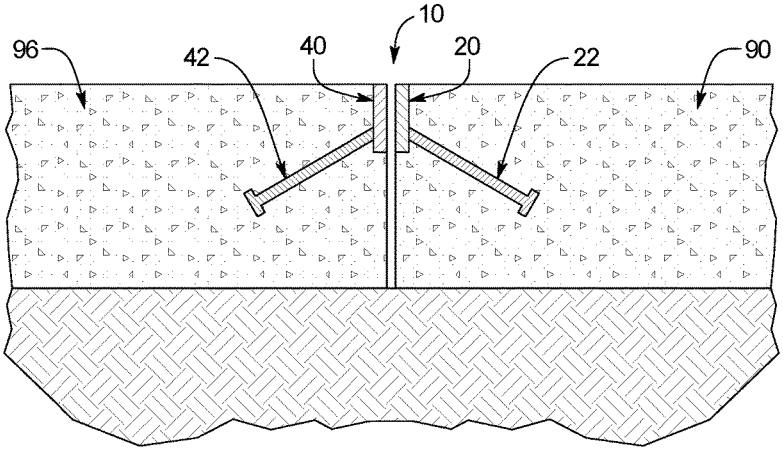

JOINT EDGE ASSEMBLY AND METHOD FOR FORMING JOINT IN OFFSET POSITION

PRIORITY CLAIM

This patent application is a continuation of, and claims priority to and the benefit of, U.S. patent application Ser. No. 15/270,784, filed on Sep. 20, 2016, which claims priority to and the benefit of U.S. Provisional Patent Application No. 62/349,926, filed Jun. 14, 2016, and claims priority to and the benefit of U.S. Provisional Patent Application No. 62/237,295, filed Oct. 5, 2015, the entire contents of each of which are incorporated herein by reference.

BACKGROUND

For various logistical and technical reasons, concrete floors are typically made up of a series of individual concrete blocks or slabs. The interface where one concrete block or slab meets another concrete block or slab is typically called a joint. Freshly poured concrete shrinks considerably as it hardens due to the chemical reaction that occurs between the cement and water (i.e., hydration). As the concrete shrinks, tensile stress accumulates in the concrete. Therefore, the joints need to be free to open and thus enable shrinkage of each of the individual concrete blocks or slabs without damaging the concrete floor.

The joint openings, however, create discontinuities in the concrete floor surface, which can cause the wheels of a vehicle (such as a forklift truck) to impact the edges of the concrete blocks or slabs which form the joint and chip small pieces of concrete from the edge of each concrete block or slab, particularly if the joint edges are not vertically aligned. This damage to the edges of concrete blocks or slabs is commonly referred to as joint spalling. Joint spalling often interrupts the normal working operations of many facilities by slowing down forklift and other truck traffic, and/or causing damage to trucks and the carried products. Severe joint spalling and uneven joints can cause loaded forklift trucks to overturn (which of course is dangerous to people in those facilities). Joint spalling can also be very expensive and time consuming to repair.

Joint edge assemblies that protect such joints between concrete blocks or slabs are widely used in the construction of concrete floors (such as concrete floors in warehouses). Examples of known joint edge assemblies are described in U.S. Pat. Nos. 6,775,952 and 8,302,359. Various known joint edge assemblies enable the joint edges to both self-open with respect to the opposite joint edge as the adjacent concrete slabs shrink during hardening.

One known joint edge assembly is generally illustrated in FIGS. 1, 2, 3, and 4. This known joint edge assembly 10 includes two separate elongated joint edge members 20 and 40 temporarily held together by a plurality of connectors 60. The connectors 60 connect the elongated joint edge members 20 and 40 along their lengths during installation. This known joint edge assembly 10 further includes a plurality of anchors 22 that extend from the elongated joint edge member 20 into the region where the concrete of the first slab 90 is to be poured such that, upon hardening of the concrete slab 90, the anchors 22 are cast within the body of the concrete slab 90. This known joint edge assembly 10 further includes a plurality of anchors 42 that extend from the elongated joint edge member 40 into the region where the concrete of the second slab 96 is to be poured such that, upon hardening of the concrete slab 96, the anchors 42 are cast within the body of the concrete slab 96. This known joint edge assembly is positioned such that the ends or edges of the concrete slabs are aligned with the respective outer surfaces of the elongated joint edge members. FIGS. 1 and 2 illustrate the joint edge assembly 10 prior to installation and before the concrete is poured, and FIG. 3 illustrates the joint edge assembly 10 after installation and after the concrete slabs have started shrinking such that the elongated joint edge members 20 and 40 have separated to a certain extent.

One known problem with this type of known joint edge assembly is that the joint will open too much or too wide as generally shown in FIG. 4 such that the elongated joint edge members 20 and 40 have separated to a greater extent than that shown in FIG. 3. The distance X between the facing sides of the elongated joint edge members 20 and 40, which is the same distance between the facing sides of the concrete slabs 90 and 96 as shown in FIG. 4, can be up to approximately 31.75 millimeters (approximately 1.25 inches) for certain installations. Such wider joints create many problems.

One problem with such wider joints is that as the joint becomes wider, the joint allows more engagement by the tires of the vehicles (such as forklift trucks) which can damage the joint. More specifically, wheels or tires with smaller diameters literally partially enter the joint as generally illustrated in FIG. 4 and engage the edge and/or inside wall of the elongated joint edge member such as member 40. This impact causes wear or damage to the rubber wheel or tire of the vehicle. This impact also loosens the engagement between the elongated joint edge member 40 and the slab 96. A series of these impacts can cause the concrete of the slab 96 behind or under the member 40 to break or crack, and possibly cause partial or complete disengagement of the elongated member 40 from slab 96. It should be appreciated that the same damage can happen to member 20 and slab 90 when the vehicles are moving in that direction.

Another problem with such wider joints is that as the joint becomes wider, the joint enables more contaminants (such as water) to enter the joint, which can damage the joint. While filler materials (such as elastomeric materials) can be used to fill these openings between the joints, as the concrete slabs continue to shrink, such filler materials often do not prevent contaminants from entering the joint.

One known attempt at solving these problems is generally illustrated in FIGS. 5, 6, and 7. This known joint edge assembly 110 includes two separate elongated joint edge members 120 and 140 temporarily held together by a plurality of connectors (not shown) which connect the elongated joint edge members 120 and 140 along their lengths during installation. This known joint edge assembly 110 further includes a plurality of anchors 122 that extend from the elongated joint edge member 120 into the region where the concrete of the first slab 190 is to be poured such that, upon hardening of the concrete slab 190, the anchors 122 are integrally cast within the body of the concrete slab 90. This known joint edge assembly 110 further includes a plurality of anchors 142 that extend from the elongated joint edge member 140 into the region where the concrete of the second slab 196 is to be poured such that, upon hardening of the concrete slab 196, the anchors 142 are integrally cast within the body of the concrete slab 196. The known joint edge assembly is positioned such that the ends of the slabs are aligned with the outer surfaces of the elongated joint edge members. A filler material is positioned in the joint between member 120 and 140 to prevent the wheels of the vehicles from entering the joint.

This known joint edge assembly 110 includes an elongated metal plate 180 attached to the bottom edge of the elongated joint member 120. FIG. 5 illustrates the joint edge assembly 110 after installation and immediately after the concrete is poured. This metal plate 180 is positioned to prevent the filler material above the plate from leaking into the portion of the joint below the metal plate 180.

FIG. 6 illustrates the joint edge assembly 110 after installation and after the concrete has started shrinking such that the elongated joint edge members 120 and 140 have separated and such that: (a) the distance between the facing sides of the concrete slabs 190 and 196 is X-A; and (b) the distance between the facing sides of the elongated joint edge members 120 and 140 is X-A. In various installations, X-A is approximately 9.525 millimeters (approximately 0.375 inches). As shown in FIG. 6, the metal plate 180 prevents the filler material above the plate from leaking into the portion of the joint below the metal plate 180.

FIG. 7 illustrates the joint edge assembly 110 after installation and after the concrete has shrunk further such that the elongated joint edge members 120 and 140 have separated to a greater extent than shown in FIG. 6 such that: (a) the distance between the facing sides of the concrete slabs 190 and 196 is X; and (b) the distance between the facing sides of the elongated joint edge members 120 and 140 is X. In various installations, X is approximately 20 millimeters (approximately 0.80 inches). As can be seen in FIG. 6, when the joint only opens to a limited extent (e.g., distance X-A), the metal plate 180 prevents the filler from entering the entire joint and specifically below the elongated joint edge members. However, as can be seen in FIG. 7, when the joint opens to a further extent (e.g., distance X), the metal plate 180 does not prevent the filler from entering the area of the joint below the metal plate 180. Additionally, the metal plate 180 cannot be made longer or substantially longer to prevent this filler leakage because that would cause weakness in the concrete slab 196. Thus, this known joint assembly works for certain sized joint openings, such as shown in FIG. 6, but does not work for larger sized joint openings, such as shown in FIG. 7.

Additionally, it is not practical or cost effective to solve this problem by making the elongated joint edge member 120, the elongated joint edge member 140, or the plate 180 wider because these members become too heavy and too costly.

Accordingly, there is a need for a joint forming apparatus and method that solves the above problems.

SUMMARY

Various embodiments of the present disclosure provide a joint edge assembly and a method for forming a joint in an offset position which solves the above problems. In one embodiment, the joint edge assembly of the present disclosure protects the joint edges of adjacent concrete slabs, and enables the joint edges to both self-open and move laterally to a significant extent with respect to the opposite joint edges as the concrete shrinks during hardening.

In various embodiments, the joint edge assembly generally includes: (1) a longitudinal joint rail having two separate elongated joint edge members; (2) a plurality of connectors which connect the elongated joint edge members along their length during installation; (3) a plurality of anchors that extend from each of the elongated joint edge members into the region where the concrete of the slab is to be poured such that, upon hardening of the concrete slab, the anchors are cast within the body of the concrete slab; (4) a closure bar or member such as an elongated upside down L-shaped closure bar or member; and (5) a plurality of anchors that extend from the closure bar into the region where the concrete of the slab is to be poured such that, upon hardening of the concrete slab, the anchors are cast within the body of the concrete slab.

The method of the present disclosure includes positioning this joint edge assembly in an offset position from where the joint will be formed before either of the two adjacent concrete slabs are poured. Temporary formwork is used to position the elongated joint edge members and the closure bar such that they are oriented adjacent to or along the length of the joint between the adjacent concrete slab sections, and parallel to the ground surface which defines a generally flat reference plane. More specifically, the temporary formwork is configured such that: (1) the slab engagement surface of the first joint edge member extends in a vertical or substantially vertical plane inwardly (with respect to the first concrete slab) of the vertically extending plane in which the vertically extending side or end surface of the first concrete slab will lie; (2) the slab engagement side of the mounting leg of the closure bar extends in a vertical or substantially vertical plane inwardly (with respect to the first concrete slab) of the vertically extending plane in which the vertically extending side or end surface of the first concrete slab will lie; and (3) the opposite or second slab facing side of the mounting leg of the closure bar extends in a same vertical or substantially vertical plane in which the vertically extending side or end surface of the first concrete slab will lie. As the concrete slabs shrink and separate from one another, the closure bar moves with the first concrete slab away from second concrete slab, but the elongated closure head extends horizontally far enough to keep the joint substantially closed even as the joint opens a substantial distance. This prevents the filler from leaking into the lower substantial portion of the joint and does not require the elongated joint edge members to be made wider, heavier, or more costly.

In various other embodiments of the method of the present disclosure, the joint edge assembly generally includes: (1) a longitudinal joint rail having two separate elongated joint edge members; (2) a plurality of connectors which connect the elongated joint edge members along their length during installation; and (3) a plurality of anchors that extend from each of the elongated joint edge members into the regions where the concrete of the slabs are to be poured such that, upon hardening of the concrete slabs, the anchors are cast within the bodies of the respective concrete slabs. In these embodiments, the method of the present disclosure includes positioning this joint edge assembly in an offset position from where the joint will be formed before either of the two adjacent concrete slabs are poured, and specifically includes using temporary formwork to position the elongated joint edge members such that they are oriented adjacent to the length of the joint that will be formed between the adjacent concrete slab sections, and parallel to the ground surface which defines a generally flat reference plane. More specifically, the method includes configuring the temporary formwork such that: (1) the slab engagement surface of the first joint edge member extends in a first vertical or substantially vertical plane directly adjacent to the vertically extending plane in which the vertically extending side or end surface of the first concrete slab will lie such that the slab engagement surface of the first joint edge member will engage the vertically extending side or end surface of the first concrete slab after the first concrete slab is poured; (2) the opposite or second slab facing side of the first joint edge member extends in a second vertical or substantially vertical plane inwardly (relative to the second concrete slab) of the vertical plane in which the vertically extending side or end surface of the second concrete slab will lie after the second concrete slab is poured; (3) the first slab facing side of the second joint edge member extends in a third vertical or substantially vertical plane further inwardly (relative to the second concrete slab) of the vertical plane in which the vertically extending side or end surface of the second concrete slab will lie after the second concrete slab is poured; and (4) the slab engagement surface of the second joint edge member extends in a vertical or substantially vertical plane even further inwardly (relative to the second concrete slab) of the vertical plane in which the vertically extending side or end surface of the second concrete slab will lie after the second concrete slab is poured. As the first and second concrete slabs shrink and separate from one another, the first and second elongated members prevent the filler from leaking into the lower substantial portion of the joint and do not require the elongated joint edge members to be made wider, heavier, or more costly.

In various other embodiments of the method of the present disclosure, the joint edge assembly generally includes: (1) a longitudinal joint rail having two separate elongated joint edge members; (2) a plurality of connectors which connect the elongated joint edge members along their length during installation; and (3) a plurality of anchors that extend from each of the elongated joint edge members into the regions where the concrete of the slabs are to be poured such that, upon hardening of the concrete slabs, the anchors are cast within the bodies of the respective concrete slabs. In these embodiments, the method of the present disclosure includes positioning this joint edge assembly in an offset position where the joint will be formed before either of the two adjacent concrete slabs are poured, and specifically includes using temporary formwork to position the elongated joint edge members such that they are oriented adjacent to the length of the joint between the adjacent concrete slabs, and parallel to the ground surface which defines a generally flat reference plane.

More specifically, the method includes configuring the temporary formwork such that: (1) the slab engagement surface of the second joint edge member extends in a first vertical or substantially vertical plane directly adjacent to the vertically extending plane in which the vertically extending side or end surface of the second concrete slab will lie such that the slab engagement surface of the second joint edge member will engage the vertically extending side or end surface of the second concrete slab after the second concrete slab is poured; (2) the opposite or first slab facing side of the second joint edge member extends in a second vertical or substantially vertical plane inwardly (relative to the first concrete slab) of the vertical plane in which the vertically extending side or end surface of the first concrete slab will lie after the first concrete slab is poured; (3) the second slab facing side of the first joint edge member extends in a third vertical or substantially vertical plane further inwardly (relative to the first concrete slab) of the vertical plane in which the vertically extending side or end surface of the first concrete slab will lie after the first concrete slab is poured; and (4) the slab engagement surface of the first joint edge member extends in a vertical or substantially vertical plane even further inwardly (relative to the first concrete slab) of the vertical plane in which the vertically extending side or end surface of the first concrete slab will lie after the first concrete slab is poured. As the concrete slabs shrink and separate from one another, the first and second elongated members prevent the joint from opening and allowing the filler from leaking into the lower substantial portions of the joint and do not require the elongated joint edge members to be made wider, heavier, or more costly.

In further various embodiments of the present disclosure, the joint edge assembly generally includes: (1) a longitudinal joint rail having two separate elongated joint edge members; (2) a plurality of connectors which connect the elongated joint edge members along their length during installation; (3) a plurality of anchors that extend from each of the elongated joint edge members into the regions where the concrete of the slabs are to be poured such that, upon hardening of the concrete slabs, the anchors are cast within the bodies of the respective concrete slabs; and (4) a plurality of height adjusters fixed to the slab engagement face of the first joint edge member. Each height adjusters defines a variable opening (such as a slot) for a first formwork fastener and second non-variable opening for a second formwork fastener. The plurality of height adjusters enable the relative height of the first and second joint edge members to be adjusted relative to the formwork below the first and second joint edge members.

Various addition embodiments of the method of the present disclosure include positioning the joint edge assembly (with the height adjusters) as described above in an offset position, and positioning first formwork fasteners through the variable openings in the height adjusters and into the formwork below the first and second joint edge members. These methods further include adjusting or setting the height of the first and second joint edge members relative to the formwork below the first and second joint edge members and then positioning second formwork fasteners through the non-variable openings in the height adjusters and into the formwork below the first and second joint edge members to fix the height of the first and second joint edge members relative to the formwork below the first and second joint edge members.

Additional features and advantages of the present invention are described in, and will be apparent from, the following Detailed Description and the Figures.

BRIEF DESCRIPTION OF THE FIGURES

FIG. 1 is a perspective view of a known joint edge assembly.

FIG. 2 is an end view of the known joint edge assembly of FIG. 1.

FIG. 3 is a cross-sectional view of the known joint edge assembly of FIG. 1 shown mounted to two concrete slabs, and illustrates the separation of the two concrete slabs after they have shrunk to a certain extent.

DETAILED DESCRIPTION OF EXAMPLE EMBODIMENTS

Figure 4:
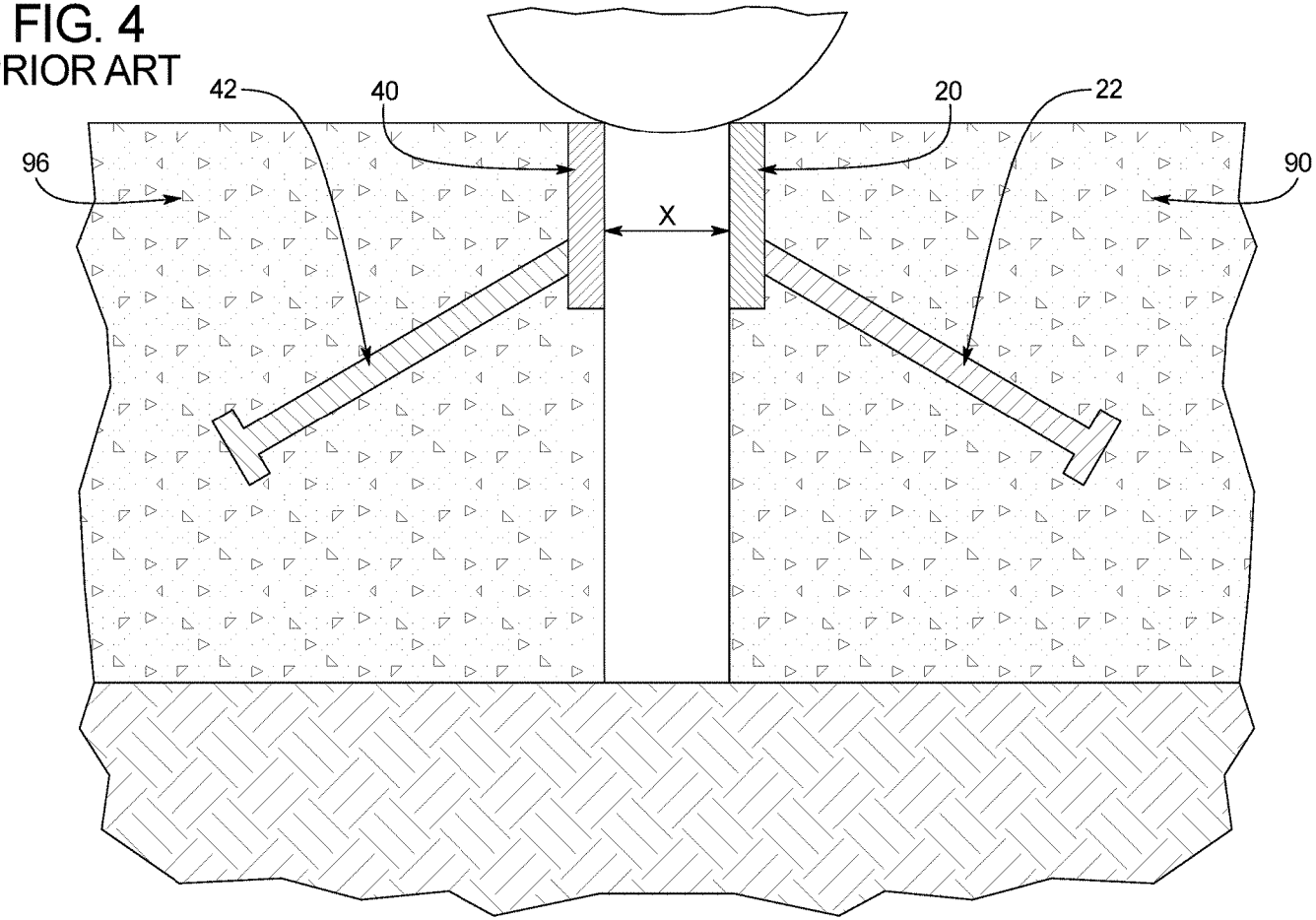
FIG. 4 PRIOR ART
FIG. 4 is a cross-sectional view of the known joint edge assembly of FIG. 1 shown mounted to two concrete slabs, and illustrates the further separation of the two concrete slabs after they have further shrunk to a greater extent than shown in FIG. 3.
Figure 5:
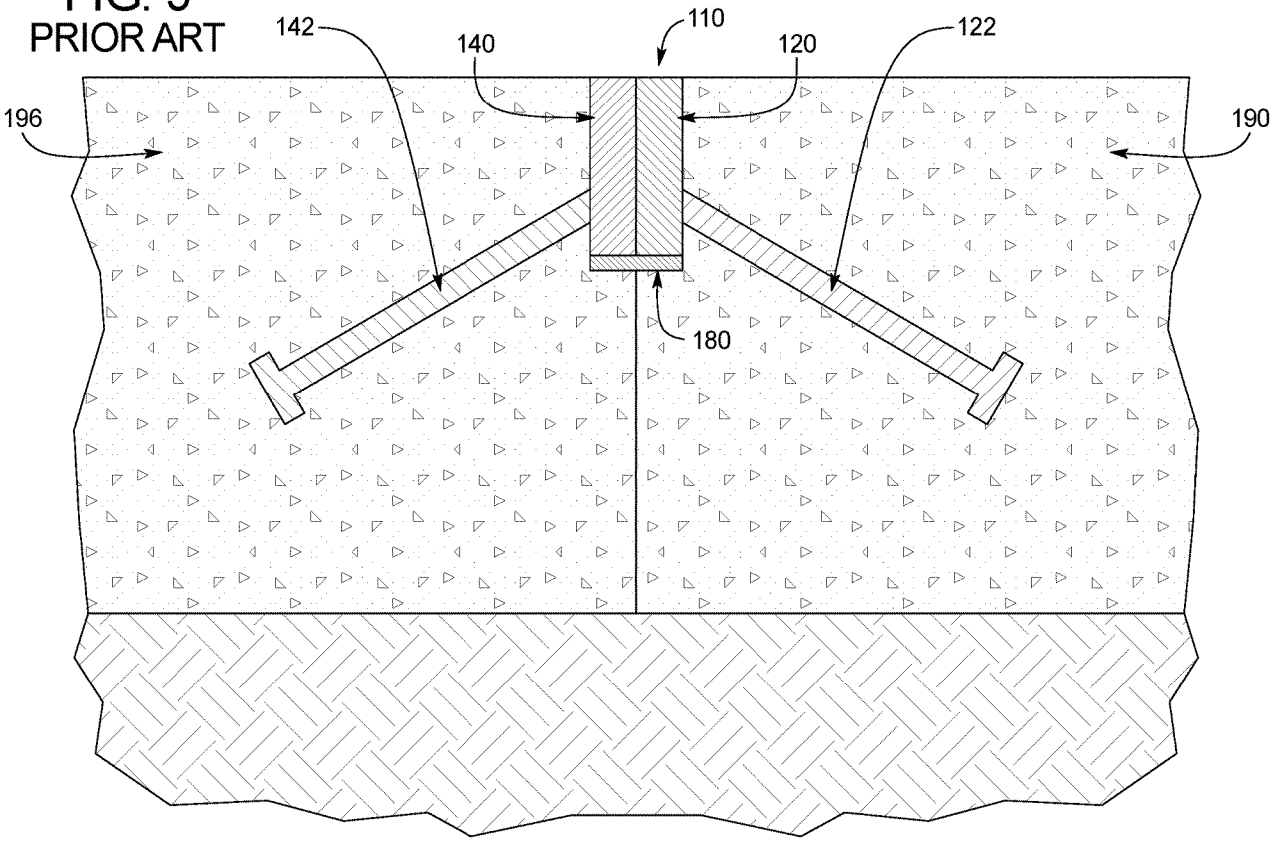
FIG. 5 PRIOR ART
FIG. 5 is a cross-sectional view of another known joint edge assembly, shown mounted to two concrete slabs after installation and before the two concrete slabs have shrunk.
Figure 6:
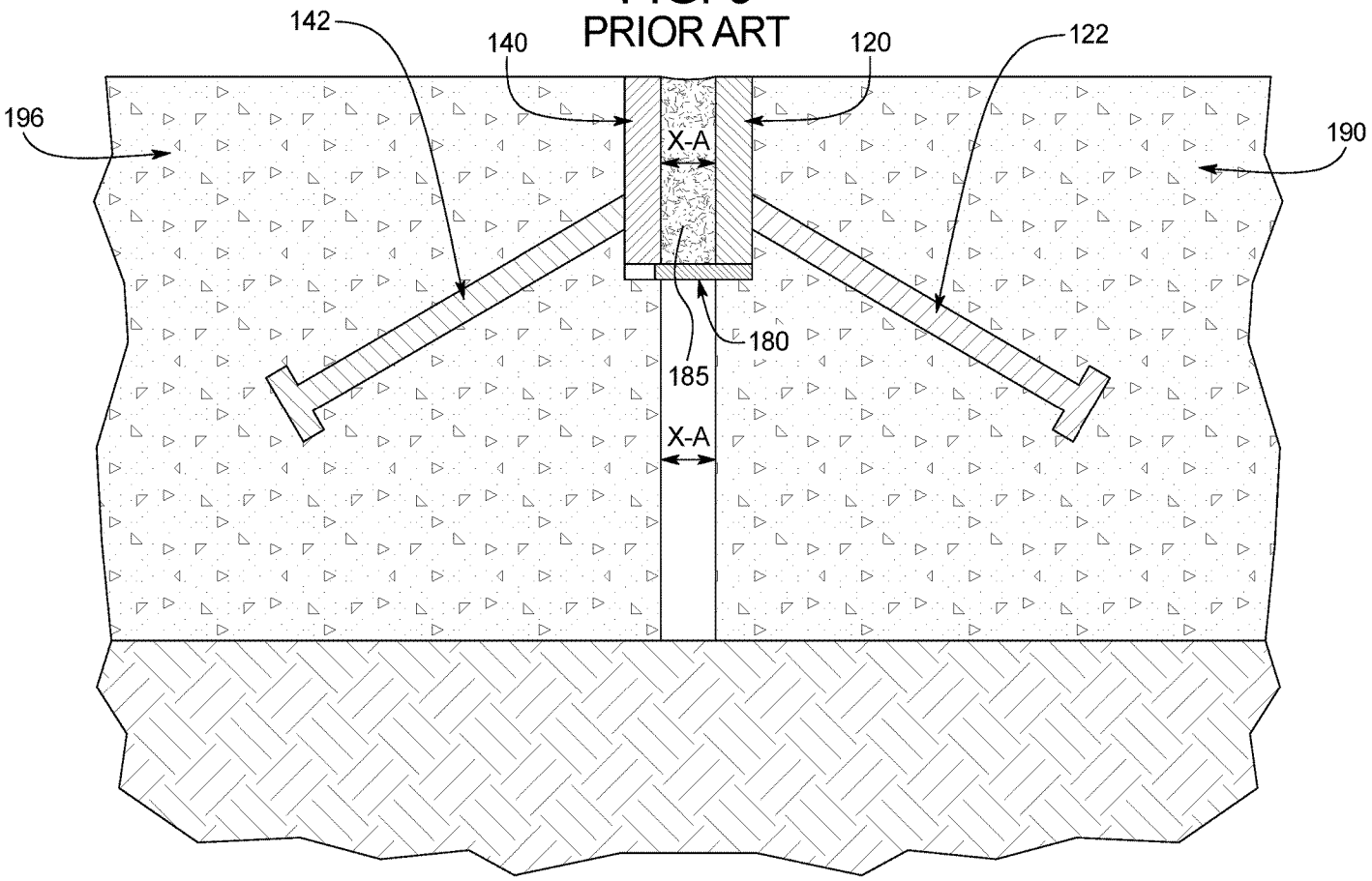
FIG. 6 PRIOR ART
FIG. 6 is a cross-sectional view of the known joint edge assembly of FIG. 5 shown mounted to two concrete slabs, and illustrates the separation of the two concrete slabs after they have shrunk to a certain extent.
Figure 7:
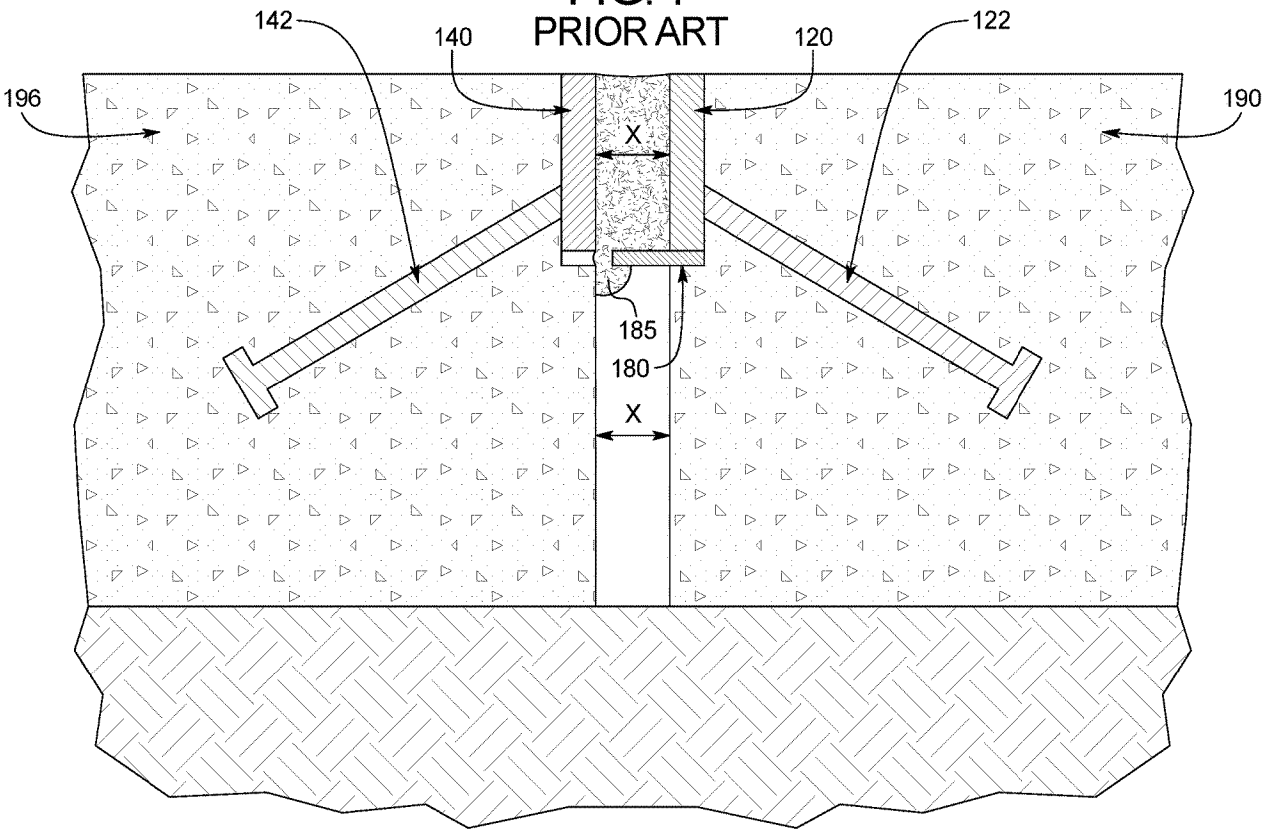
FIG. 7 PRIOR ART
FIG. 7 is a cross-sectional view of the known joint edge assembly of FIG. 5 shown mounted to two concrete slabs, and illustrates the further separation of the two concrete slabs after they have further shrunk to a greater extent than that shown in FIG. 6.
Figure 8:
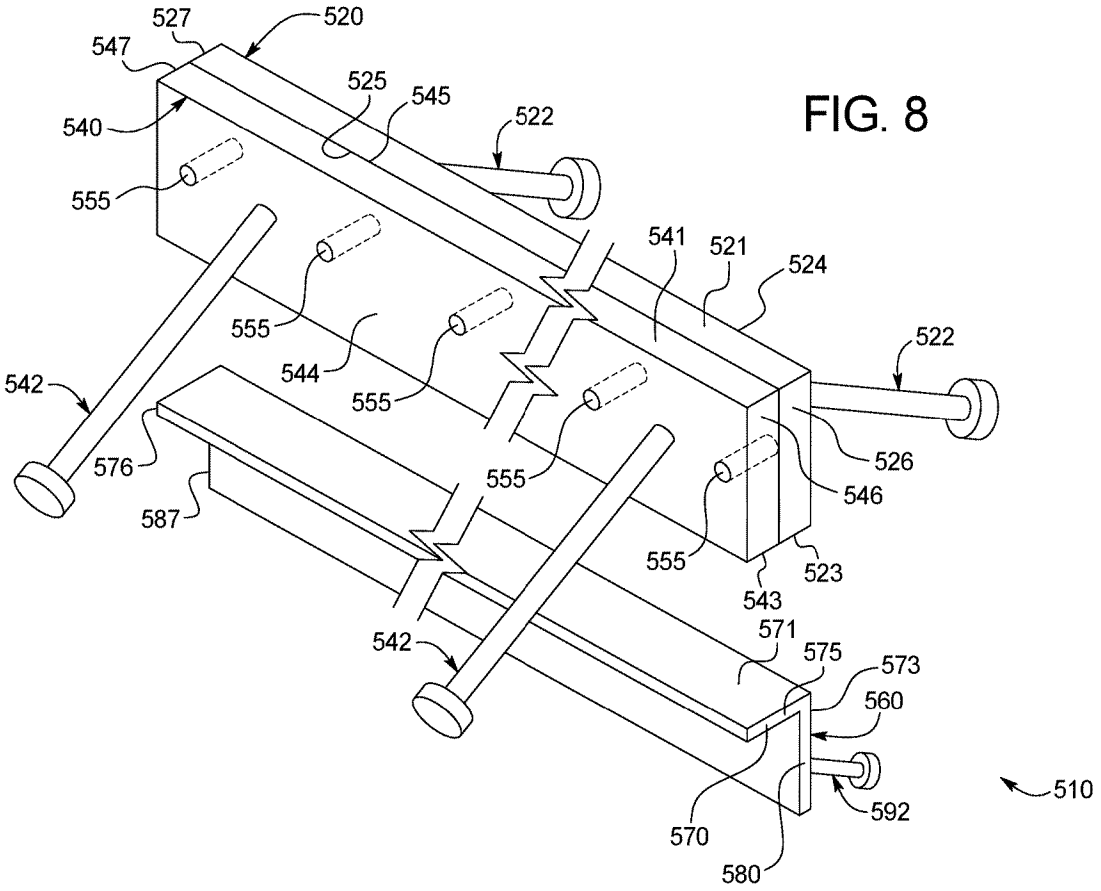
FIG. 8 is a partially exploded perspective view of one embodiment of the joint edge assembly of the present disclosure.
Figure 9:
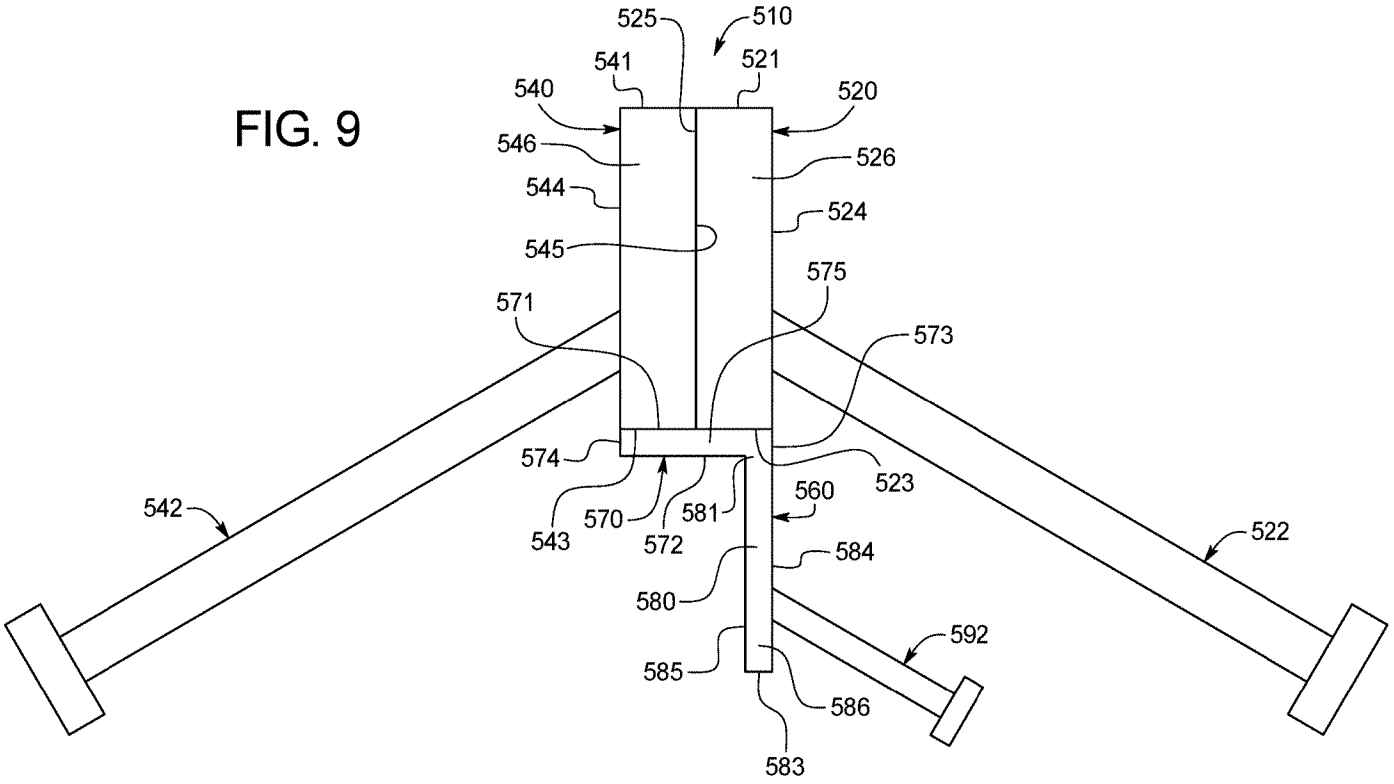
FIG. 9 is an end view of the joint edge assembly of FIG. 8.

Various embodiments of the present disclosure provide a joint edge assembly which solves the above problems. Referring now to FIGS. 8, 9, 10, and 11, one example embodiment of the joint edge assembly of the present disclosure is generally indicated by numeral 510. The joint edge assembly 510 generally includes: (1) an elongated longitudinal joint rail having a first elongated joint edge member 520 and a second elongated joint edge member 540; (2) a plurality of connectors 555 which connect the first and second elongated joint edge members 520 and 540 along their lengths during installation; (3) a first plurality or set of anchors 522 integrally connected to and extending outwardly and downwardly from the first elongated joint edge member 520; (4) a second plurality or set of anchors 542 integrally connected to and extending outwardly and downwardly from the second elongated joint edge member 540; (5) an elongated upside down L-shaped closure bar 560 having an elongated closure head 570 and an elongated mounting leg 580; and (6) a third plurality or set of anchors 592 integrally connected to and extending from the mounting leg 580 of the closure bar 560.

More specifically, the first elongated joint edge member 520 in this illustrated example embodiment includes an elongated body having an upper edge 521, a lower edge 523, a slab engagement side 524, a joint member engagement side 525, a first end edge 526, and a second end edge 527. Likewise, the second elongated joint edge member 540 in this illustrated example embodiment includes an elongated body have an upper edge 541, a lower edge 543, a slab engagement side 544, a joint member engagement side 545, a first end edge 546, and a second end edge 547.

The elongated joint edge members are each made from steel in this example embodiment. It should be appreciated that the elongated joint edge members can be made from other suitable materials in accordance with the present disclosure. It should also be appreciated that the elongated joint edge members can be made having other suitable shapes and sizes in accordance with the present disclosure.

The plurality of connectors 555 connect the first and second elongated joint edge members 520 and 540 along their lengths during installation. The connectors 555 are respectively extendable though holes drilled or otherwise formed in the elongated joint edge members at longitudinal intervals. In one embodiment, the connectors fit within the holes via an interference fit, and particularly are of a slightly larger diameter than the holes such that they fit in the holes is substantially tight manner. This substantially eliminates play in the two joint edge members 520 and 540. The connectors 555 enable the elongated joint edge members 520 and 540 to self-release under the force of the concrete slabs 590 and 596 shrinking during hardening.

The connectors are made from a plastic such as nylon in this example embodiment. It should be appreciated that the connectors can be made from other suitable materials and in other suitable manners in accordance with the present disclosure. The material of the connectors can be suitably chosen according to the design tensile strength of the concrete such that the connectors yield under the shrinkage stress of the concrete slabs 590 and 596. The tensile strength can also be variable according to the conditions and application of the concrete slabs. As the concrete slabs 590 and 596 shrink, the anchors 522 and 542 (which are respectively embedded in the concrete slabs 590 and 596) pull the elongated joint edge members 520 and 540 apart. It should also be appreciated that the connectors can be made having other suitable shapes and sizes in accordance with the present disclosure. It should further be appreciated that the quantity and/or positioning of connectors can vary in accordance with the present disclosure. It should further be appreciated that in various embodiments, the joint edge assembly does not include such connectors in accordance with the present disclosure but rather includes another suitable mechanism for maintaining the first and second elongated joint edge members together during installation.

The first plurality or set of anchors 522 are integrally connected to and extend outwardly and downwardly from the slab engaging side 524 of the first elongated joint edge member 520. After the first elongated joint edge member 520 is installed, each anchor 522 extends into the region where the concrete of the first slab 590 is to be poured such that, upon hardening of the first concrete slab 590, the anchors 522 are cast within the body of the first concrete slab 590. The anchors 522 are made from steel and welded to the slab engagement side 524 of the first elongated joint edge member 520 in this example embodiment. It should be appreciated that the anchors 522 can be made from other suitable materials and attached to the elongated joint edge member 520 in other suitable manners in accordance with the present disclosure. It should also be appreciated that the anchors can be made having other suitable shapes and sizes in accordance with the present disclosure. It should further be appreciated that the quantity and/or positioning of anchors can vary in accordance with the present disclosure.

The second plurality or set of anchors 542 are integrally connected to and extend outwardly and downwardly from the slab engaging side 544 of the second elongated joint edge member 540. After the second elongated joint edge member 540 is installed, each anchor 542 extends into the region where the concrete of the second slab 596 is to be poured such that, upon hardening of the second concrete slab 596, the anchors 542 are cast within the body of the second concrete slab 596. The anchors 542 are made from steel and welded to the slab engagement side 544 of the second elongated joint edge member 540 in this example embodiment. It should be appreciated that the anchors can be made from other suitable materials and attached to the elongated joint edge member in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

The elongated upside down L-shaped closure bar 560 includes an elongated closure head 570 and an elongated mounting leg 580 integrally formed with and connected to the elongated closure head 570. The elongated closure head 570 in this illustrated example embodiment includes an elongated horizontally or substantially horizontally extending body have an upper surface 571, a lower surface 572, a slab engagement end or edge 573, a joint member engagement end or edge 574, a first end edge 575, and a second end edge 576. The mounting leg 580 in this illustrated example embodiment includes an elongated vertically or substantially vertically extending body have an upper edge 581, a lower end or edge 583, a slab engagement side 584, a joint member engagement side 585, a first end edge 586, and a second end edge 587. The upper end or edge 581 of the mounting leg 580 is integrally formed with the lower surface 572 of the closure head 570.

The closure bar 560 is made from steel in this example embodiment. It should be appreciated that the closure bar can be made from other suitable materials in accordance with the present disclosure. It should also be appreciated that the closure bar can be made having other suitable shapes in accordance with the present disclosure.

The third plurality or set of anchors 592 are each integrally connected to and extend downwardly from the slab engaging side 584 of the mounting leg 580 of the closure bar 560. After the closure bar 560 is installed, each anchor 582 extends into the region where the concrete of the first slab 590 is to be poured such that, upon hardening of the first concrete slab 590, the anchors 592 are cast within the body of the first concrete slab 590. The anchors are made from steel and welded to the slab engagement side 584 of the mounting leg 580 of the closure bar 560 in this example embodiment. It should be appreciated that the anchors can be made from other suitable materials and attached to the closure bar 560 in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

Figure 10:
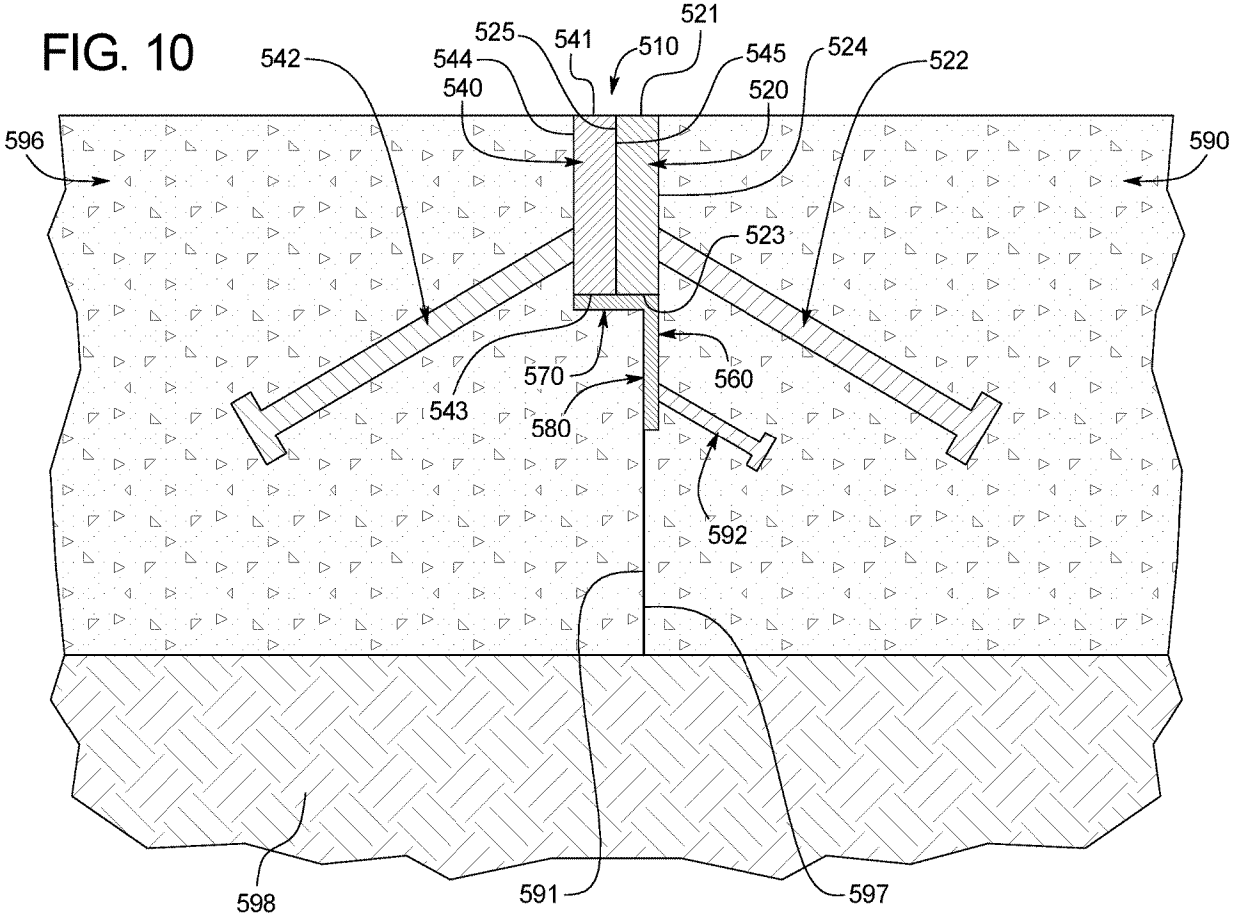
FIG. 10 is a cross-sectional view of the joint edge assembly of FIG. 8 shown mounted to two concrete slabs after installation, and showing the position of the joint edge assembly relative to the plane of the joint and the ends or edges of the adjacent concrete slabs.
Figure 11:
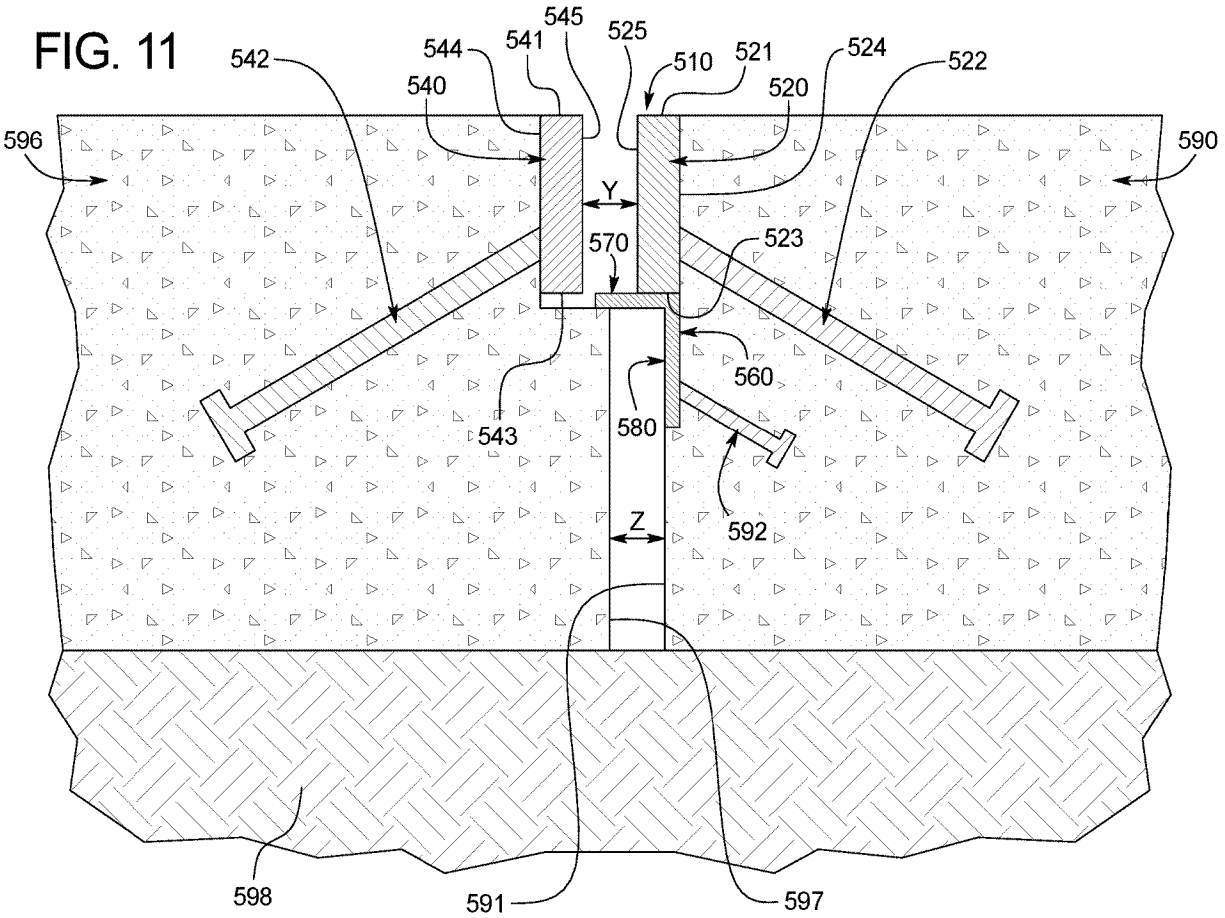
FIG. 11 is a partial cross-sectional view of the joint edge assembly of FIG. 8 shown mounted to two concrete slabs after installation, and showing the position of the joint edge assembly relative to the concrete slabs and the separation of the two concrete slabs after they have shrunk to a substantial extent.

It should be appreciated that various suitable formwork (not shown) will be used in the installation of the joint edge assembly of the present disclosure in accordance with the method of the present disclosure. As specifically shown in FIGS. 10 and 11, the method of the present disclosure includes positioning the joint edge assembly 510 where the joint will be formed before either of the two adjacent concrete slabs 590 and 596 are poured. Temporary formwork (not shown) is used to position the elongated joint edge members 520 and 540 and the closure bar 560 such that they are oriented in offset positions along the length of the joint between the adjacent concrete slab sections 590 and 596 as generally shown in FIGS. 10 and 11, and parallel to the ground surface 598 which defines a generally flat reference plane. More specifically, the temporary formwork is configured to align: (1) the slab engagement surface 524 of the first joint edge member 520 inwardly (with respect to the first concrete slab 590) of the vertically extending plane in which the vertically extending side or end surface 591 of the first concrete slab 590 will lie as best shown in FIG. 10; (2) the slab engagement side 584 of the mounting leg 580 of the closure bar 560 inwardly (with respect to the first concrete slab 590) of the vertically extending plane in which the vertically extending side or end surface 591 of the first concrete slab 590 will lie and below the elongated joint edge member 520 as best shown in FIG. 10; and (3) the opposite or second slab facing side 585 of the mounting leg 580 of the closure bar 570 to extend in a same vertical or substantially vertical plane in which the vertically extending side or end surface 591 of the first concrete slab 590 will lie.

After the joint edge assembly 510 is properly secured and aligned, the first concrete slab 590 is poured. The anchors 522 extending from the elongated joint edge member 520 and the anchors 592 extending from the closure bar 580 become embedded in the wet concrete, and provide a positive mechanical connection between the concrete slab 590 and the elongated joint edge member 520 and between the concrete slab 590 and the closure bar 560 when the concrete hardens.

After the concrete slab 590 has hardened sufficiently, the temporary formwork (not shown) is removed. After the formwork is removed, the connectors 555 hold the elongated joint edge member 540 secured to the elongated joint edge member 520 such that the second concrete slab 596 can be poured. The adjacent or second concrete slab 596 is poured and finished such that the anchors 542 extending from the elongated joint edge member 540 become embedded in the wet concrete of the adjacent concrete slab 596.

In this embodiment, the slab engagement surface 544 of the second joint edge member 540 is positioned inwardly (with respect to the second slab 596) relative to the vertically extending plane in which the vertically extending side or end surface 597 of the second concrete slab 596 will lie as best shown in FIG. 10. In this embodiment, the surface 545 of the second joint edge member 540 is also positioned inwardly (with respect to the second slab 596) relative to the vertically extending plane in which the vertically extending side or end surface 597 of the second concrete slab 596 will lie as best shown in FIG. 10. This method of the present disclosure thus positions the joint edge assembly such that, after the concrete is poured but before the concrete hardens, the joint member engagement sides of the joint edge members are offset from the joint (as opposed to aligned with the joint as in the prior known joint assemblies shown in FIGS. 3, 4, 5, 6, and 7).

As the chemical reaction between the cement and the water in the adjacent concrete slabs 590 and 596 occurs (i.e., hydration), the concrete hardens and shrinks. This causes the concrete slabs 590 and 596 to separate from one another, and the self-release connectors enable the elongated joint edge members 520 and 540 to also separate from one another. It should be appreciated that the connectors remain substantially fixed throughout the concrete pouring operation and include release elements that enable the elongated joint edge members 520 and 540 to release from each other under the force of the concrete slabs 590 and 596 shrinking during hardening, thus enabling the joint to open.

As the concrete slabs 590 and 596 shrink and separate from one another, the closure bar 560 moves with concrete slab 590 away from concrete slab 596, but the elongated closure head 570 extends horizontally far enough to keep the bottom section of the joint substantially covered or closed as best shown in FIG. 11 even as the joint opens the distance Z. As mentioned above, in various installations, Z is approximately 20 millimeters (approximately 0.80 inches). This protects substantial portions of the joint from filler leakage and does not require the elongated joint edge members or the closure bar to be made wider, heavier, or more costly.

It should be appreciated that the arrangement could be reversed such that the closure bar is attached to concrete slab 596.

It should thus be appreciated that the gap formed between the separated joint edge members can be filled with an appropriate filler or sealant without leakage.

Figure 12:
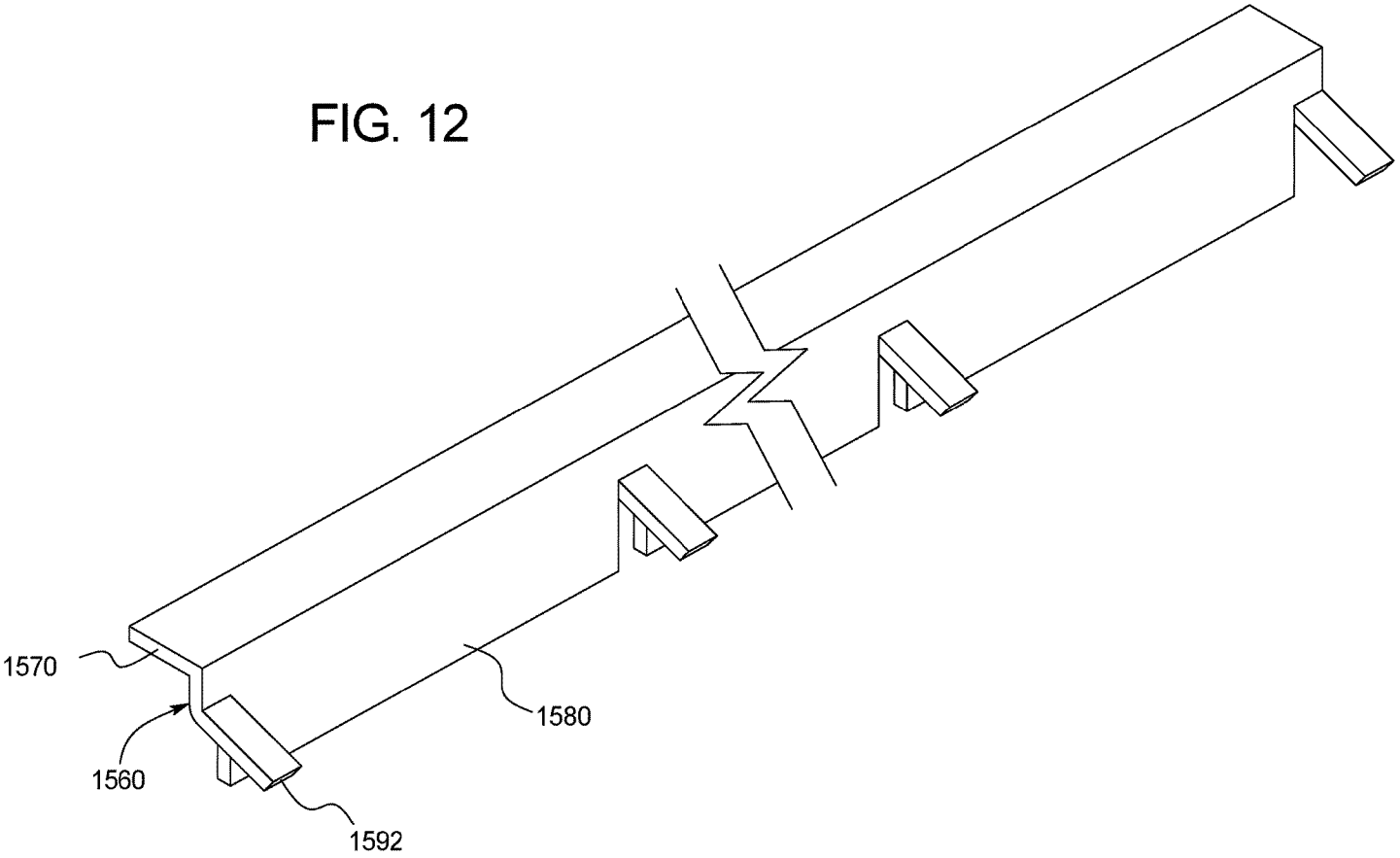
FIG. 12 is a perspective view of an alternative embodiment of the closure bar of the joint edge assembly of the present disclosure.

Referring now to FIG. 12, an alternative embodiment of the joint edge assembly of the present disclosure includes an elongated upside down L-shaped closure bar 1560 having an elongated closure head 1570, an elongated mounting leg 1580, and a plurality or set of anchors 1592 integrally connected to, formed from, and extending from the mounting leg 1580 of the closure bar 1560. The anchors 1592 are formed from parts of the mounting leg 1580 in this illustrated embodiment.

It should be appreciated from the above, that the method of the present disclosure includes using one of the embodiments of the joint edge assembly of the present disclosure to form a partially covered joint between two concrete slabs. More particularly, the method includes positioning the first elongated joint edge member and the elongated closure bar such that they are attached to the first slab and such that the slab engagement surfaces of first elongated joint edge member and the closure bar are positioned inwardly (with respect to the first slab) of the end or side surface of the first slab (as generally shown in FIGS. 10 and 11).

In an alternative embodiment (not shown), the method includes positioning the second elongated joint edge member and the elongated closure bar such that they are attached to the second slab and such that the slab engagement surfaces of the second elongated joint edge member and the closure bar extend inwardly (with respect to the second slab) of the end or side surface of the second slab.

Figure 13:
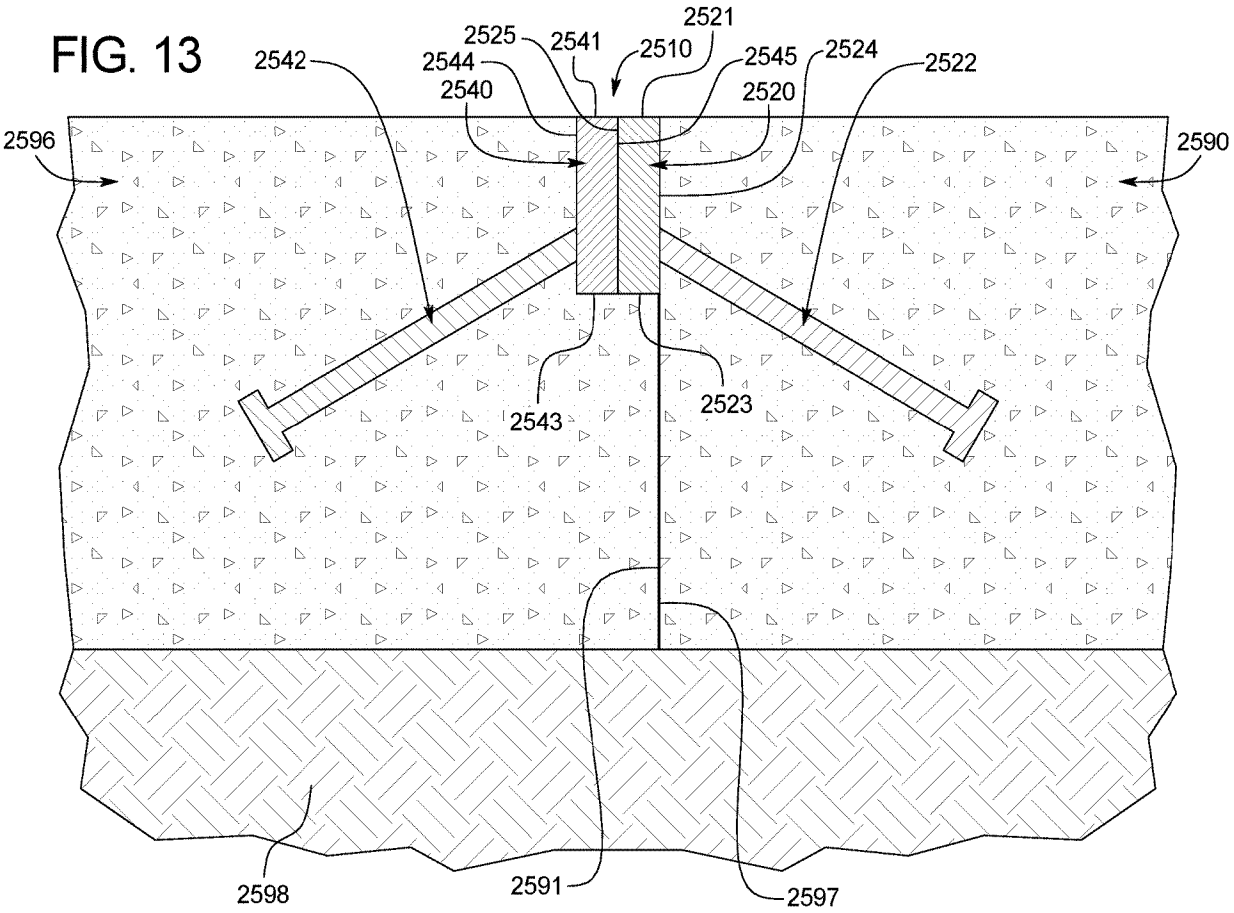
FIG. 13 is a cross-sectional view of the joint edge assembly of another embodiment of the present disclosure shown mounted to two concrete slabs after installation, and showing the position of the joint edge assembly relative to the plane of the joint and the ends or edges of the adjacent concrete slabs.
Figure 14:
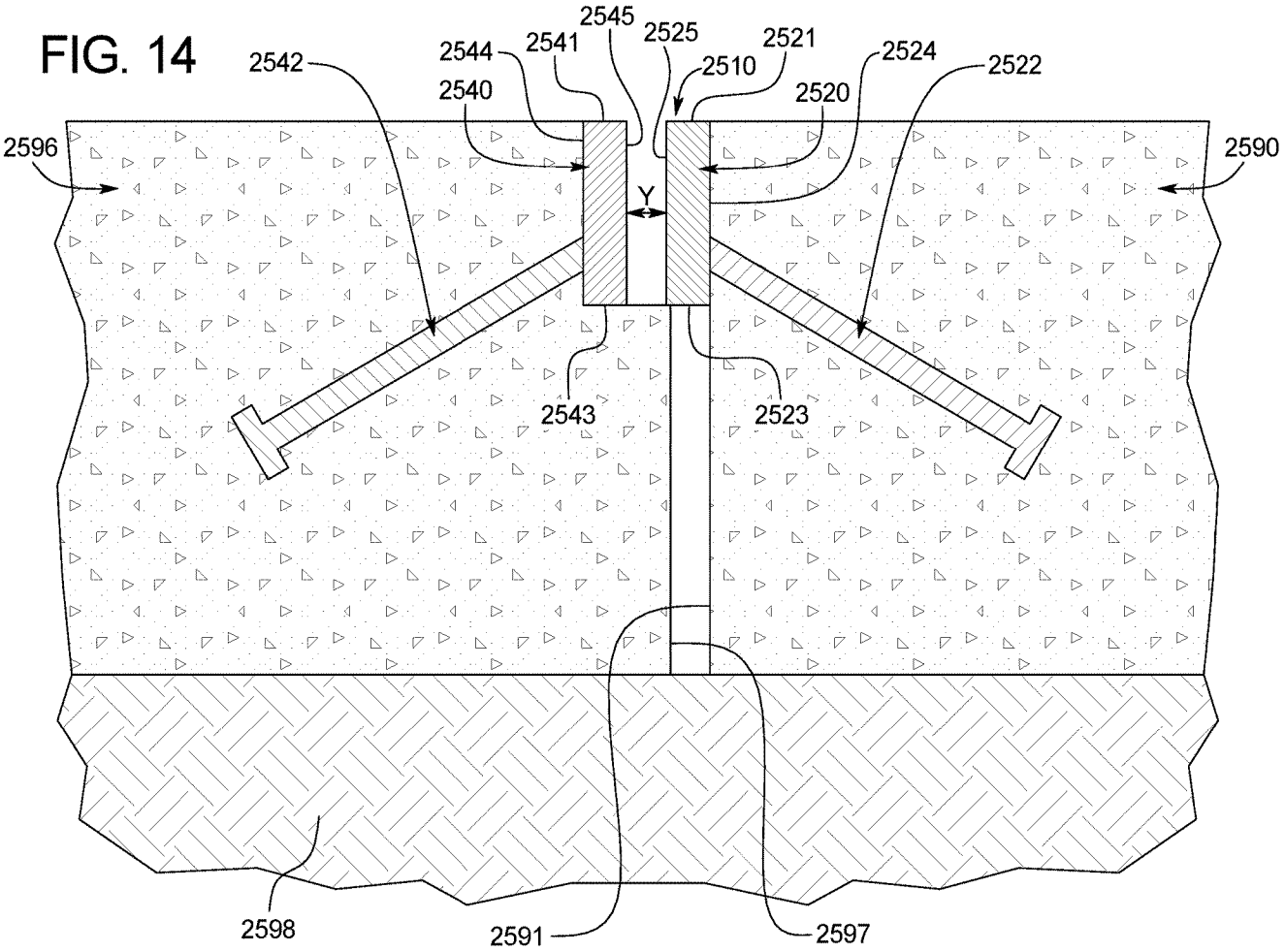
FIG. 14 is a partial cross-sectional view of the joint edge assembly of FIG. 13 shown mounted to two concrete slabs after installation, and showing the position of the joint edge assembly relative to the concrete slabs and the separation of the two concrete slabs after they have shrunk to a certain extent.

Referring now to FIGS. 13 and 14, another example embodiment of the method of the present disclosure is shown. In this embodiment, the joint edge assembly 2510 generally includes: (1) an elongated longitudinal joint rail having a first elongated joint edge member 2520 and a second elongated joint edge member 2540; (2) a plurality of connectors (not shown) which connect the first and second elongated joint edge members 2520 and 2540 along their lengths during installation; (3) a first plurality or set of anchors 2522 integrally connected to and extending outwardly and downwardly from the first elongated joint edge member 2520; and (4) a second plurality or set of anchors 2540 integrally connected to and extending outwardly and downwardly from the second elongated joint edge member 2540. More specifically, the first elongated joint edge member 2520 in this illustrated example embodiment includes an elongated body have an upper edge 2521, a lower edge 2523, a slab engagement side 2524, a joint member engagement side 2525, a first end edge (not shown), and a second end edge (not shown). Likewise, the second elongated joint edge member 2540 in this illustrated example embodiment includes an elongated body have an upper edge 2541, a lower edge 2543, a slab engagement side 2544, a joint member engagement side 2545, a first end edge (not shown), and a second end edge (not shown).

The elongated joint edge members are each made from steel in this example embodiment. It should be appreciated that the elongated joint edge members can be made from other suitable materials in accordance with the present disclosure. It should also be appreciated that the elongated joint edge members can be made having other suitable shapes and sizes in accordance with the present disclosure.

The plurality of connectors (not shown) connect the first and second elongated joint edge members 2520 and 2540 along their lengths during installation. The connectors are respectively extendable though holes drilled or otherwise formed in the elongated joint edge members at longitudinal intervals. In one embodiment, the connectors fit within the holes via an interference fit, and particularly are of a slightly larger diameter than the holes such that they fit in the holes is substantially tight manner. This substantially eliminates play in the two joint edge members 2520 and 2540. The connectors enable the elongated joint edge members to self-release under the force of the concrete slabs 2590 and 2596 shrinking during hardening.

The connectors are made from a plastic such as nylon in this example embodiment. It should be appreciated that the connectors can be made from other suitable materials and in other suitable manners in accordance with the present disclosure. The material of the connectors can be suitably chosen according to the design tensile strength of the concrete such that the connectors yield under the shrinkage stress of the concrete slabs 2590 and 2596. The tensile strength can also be variable according to the conditions and application of the concrete slabs. As the concrete slabs 2590 and 2596 shrink, the anchors 2522 and 2542 which are respectively embedded in the concrete slabs 2590 and 2596 pull the elongated joint edge members 2520 and 2540 apart. It should also be appreciated that the connectors can be made having other suitable shapes and sizes in accordance with the present disclosure. It should further be appreciated that the quantity and/or positioning of connectors can vary in accordance with the present disclosure. It should further be appreciated that in various embodiments, the joint edge assembly does not include such connectors in accordance with the present disclosure but rather includes another suitable mechanism for maintaining the first and second elongated joint edge members together during installation.

The first plurality or set of anchors 2522 are integrally connected to and extend outwardly and downwardly from the slab engaging side 2524 of the first elongated joint edge member 2520. After the first elongated joint edge member 2520 is installed, each anchor 2522 extends into the region where the concrete of the first slab 2590 is to be poured such that, upon hardening of the first concrete slab 2590, the anchors 2522 are cast within the body of the first concrete slab 2590. The anchors 2522 are made from steel and welded to the slab engagement side 2524 of the first elongated joint edge member 2520 in this example embodiment. It should be appreciated that the anchors 2522 can be made from other suitable materials and attached to the elongated joint edge member 2520 in other suitable manners in accordance with the present disclosure. It should also be appreciated that the anchors can be made having other suitable shapes and sizes in accordance with the present disclosure. It should further be appreciated that the quantity and/or positioning of anchors can vary in accordance with the present disclosure.

The second plurality or set of anchors 2542 are integrally connected to and extend outwardly and downwardly from the slab engaging side 2544 of the second elongated joint edge member 2540. After the second elongated joint edge member 2540 is installed, each anchor 2542 extends into the region where the concrete of the second slab 2596 is to be poured such that, upon hardening of the second concrete slab 2596, the anchors 2542 are cast within the body of the second concrete slab 2596. The anchors 2542 are made from steel and welded to the slab engagement side 2544 of the second elongated joint edge member 2540 in this example embodiment. It should be appreciated that the anchors can be made from other suitable materials and attached to the elongated joint edge member in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

In this illustrated embodiment, the method of the present disclosure includes positioning this joint edge assembly 2510 in an offset position from where the joint will be formed before either of the two adjacent concrete slabs 2590 and 2596 are poured, and specifically includes using temporary formwork (not shown) to position the elongated joint edge members 2520 and 2540 such that they are oriented adjacent to the length of the joint that will be formed between the adjacent concrete slab sections, and parallel to the ground surface which defines a generally flat reference plane. More specifically, the method includes configuring the temporary formwork (not shown) such that: (1) the slab engagement surface 2524 of the first joint edge member 2520 extends in a first vertical or substantially vertical plane directly adjacent to the vertically extending plane in which the vertically extending side or end surface 2591 of the first concrete slab 2522 will lie such that the slab engagement surface of the first joint edge member 2524 will engage the vertically extending side or end surface 2591 of the first concrete slab after the first concrete slab is poured; (2) the opposite or second slab facing side 2525 of the first joint edge member 2520 extends in a second vertical or substantially vertical plane inwardly (relative to the second concrete slab 2596) of the vertical plane in which the vertically extending side or end surface 2597 of the second concrete slab 2596 will lie after the second concrete slab 2596 is poured; (3) the first slab facing side 2545 of the second joint edge member 2540 extends in a third vertical or substantially vertical plane further inwardly (relative to the second concrete slab 2596) of the vertical plane in which the vertically extending side or end surface 2597 of the second concrete slab 2540 will lie after the second concrete slab 2540 is poured; and (4) the slab engagement surface 2544 of the second joint edge member 2540 extends in a vertical or substantially vertical plane even further inwardly (relative to the second concrete slab 2596) of the vertical plane in which the vertically extending side or end surface 2597 of the second concrete slab 2506 will lie after the second concrete slab 2596 is poured. As the first and second concrete slabs 2590 and 2596 shrink and separate from one another, the first and second elongated members 2520 and 2540 prevent the filler from leaking into the lower substantial portion of the joint, and does not require the elongated joint edge members to be made wider, heavier, or more costly. In the method of this embodiment, the first concrete slab is poured and then the second concrete slab is poured. In a slightly alternative method of the present disclosure, the second concrete slab is poured and then the first concrete slab is poured.

Figure 15:
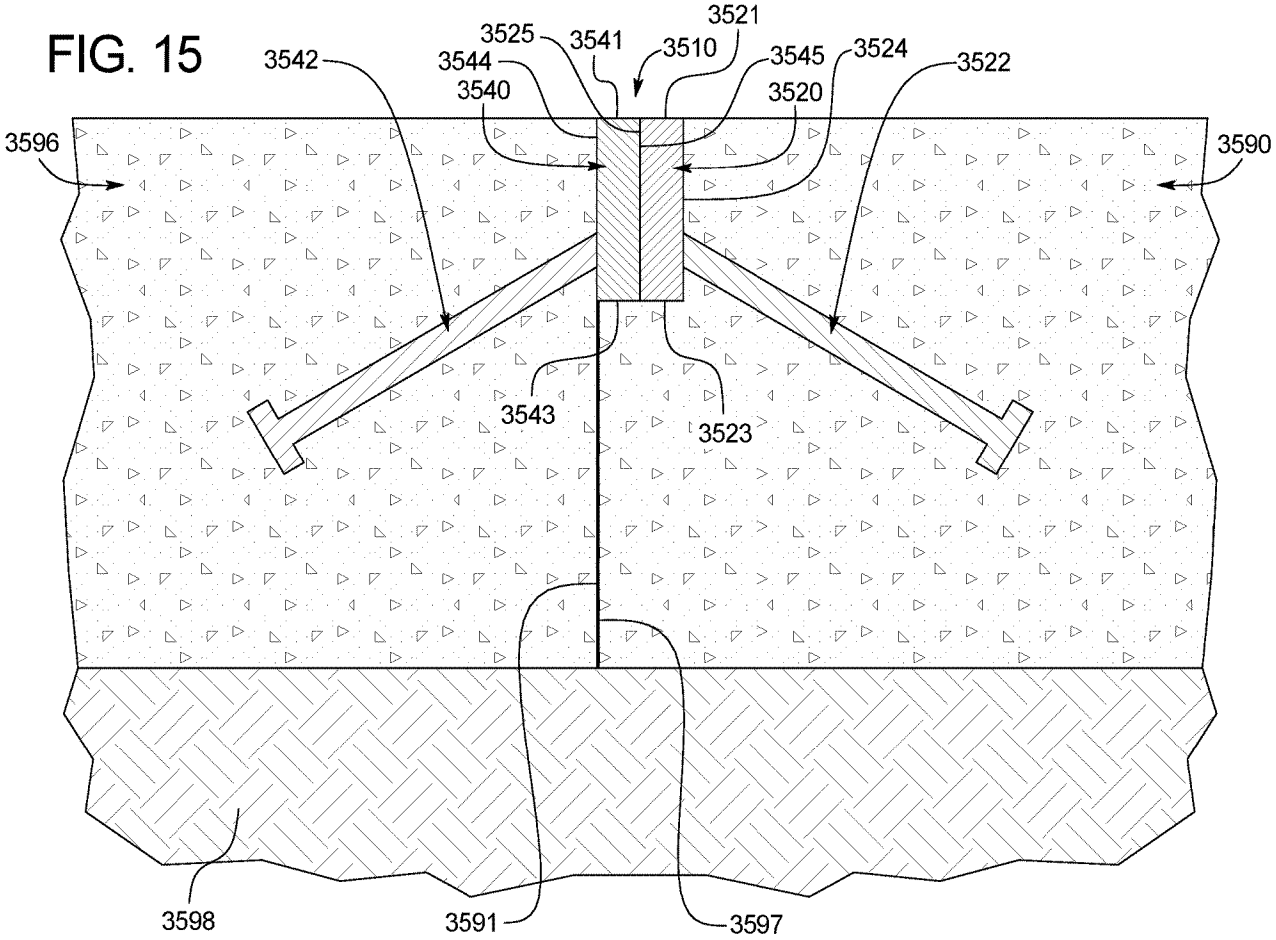
FIG. 15 is a cross-sectional view of the joint edge assembly of another embodiment of the present disclosure shown mounted to two concrete slabs after installation, and showing the position of the joint edge assembly relative to the plane of the joint and the ends or edges of the adjacent concrete slabs.
Figure 16:
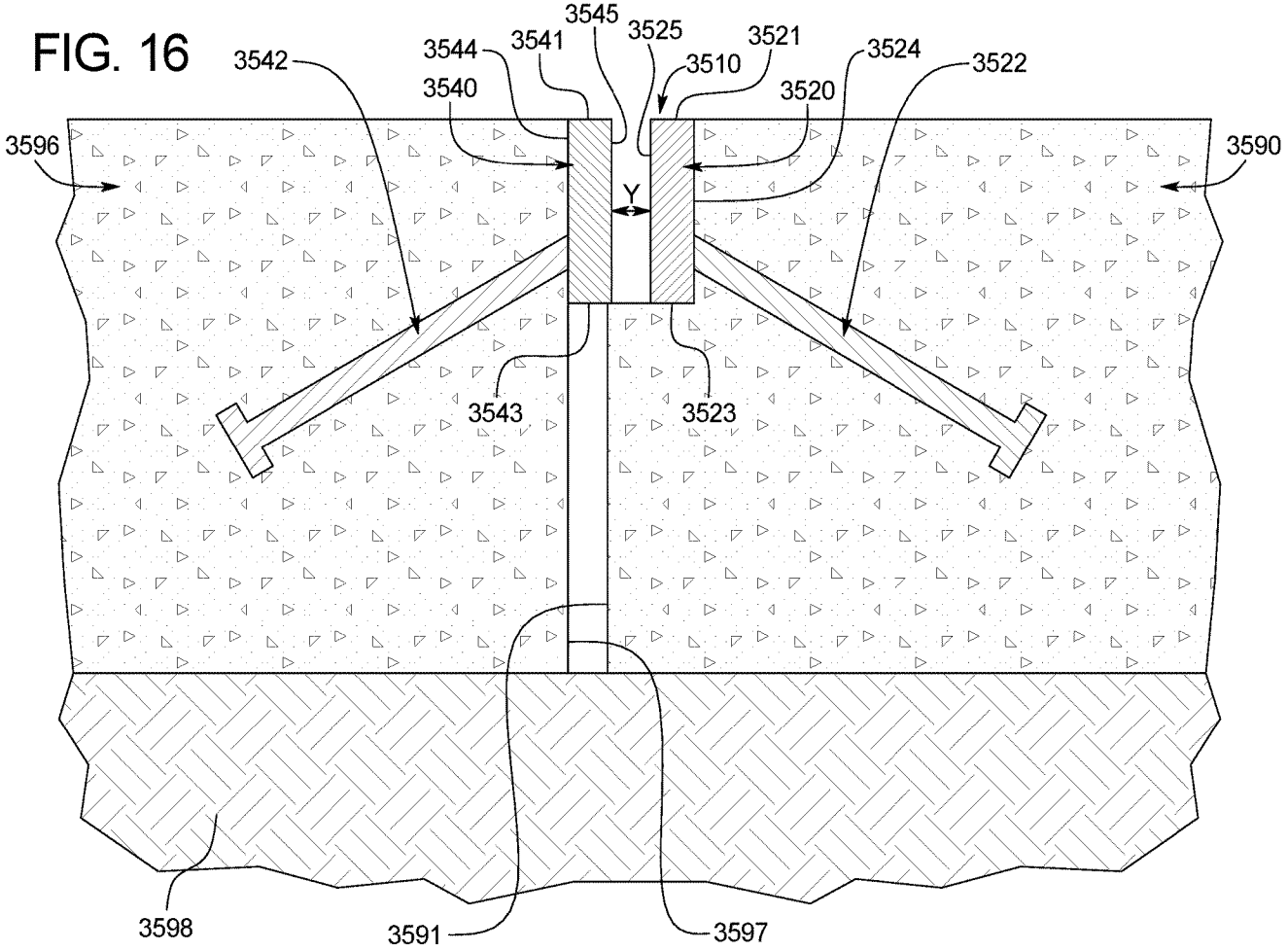
FIG. 16 is a partial cross-sectional view of the joint edge assembly of FIG. 15 shown mounted to two concrete slabs after installation, and showing the position of the joint edge assembly relative to the concrete slabs and the separation of the two concrete slabs after they have shrunk to a certain extent.
Figure 17:
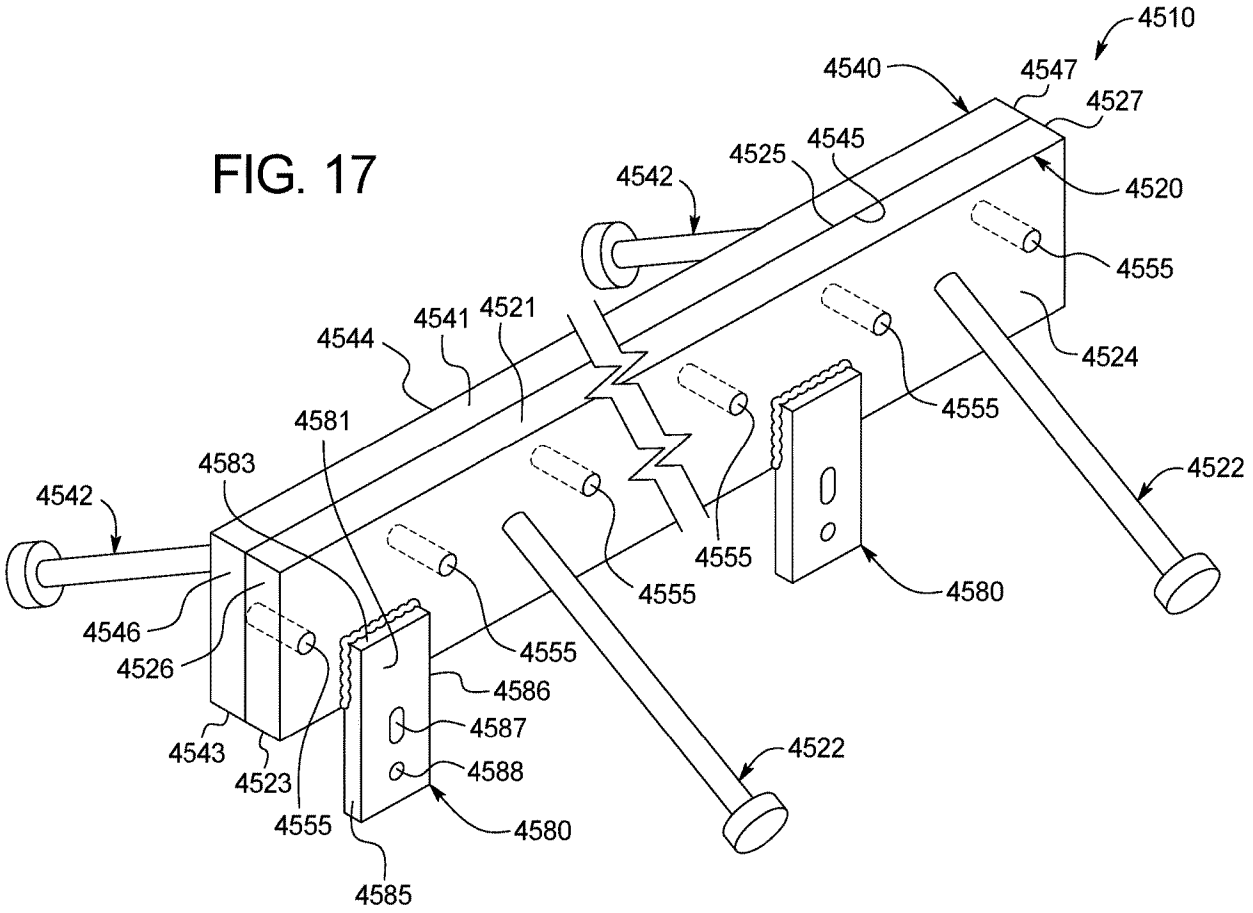
FIG. 17 is a perspective view of another embodiment of the joint edge assembly of the present disclosure.
Figure 18:
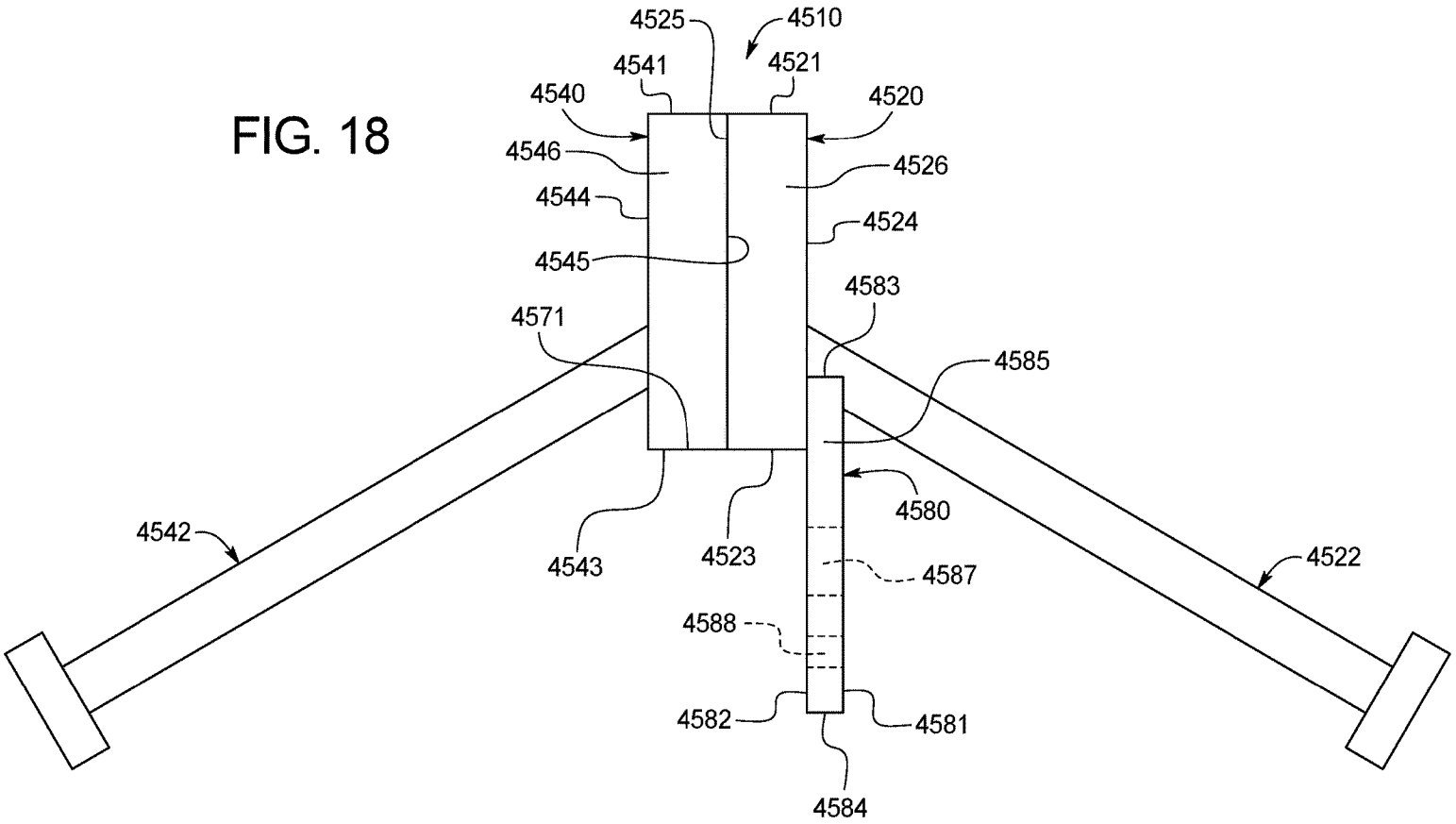
FIG. 18 is an end view of the joint edge assembly of FIG. 17.
Figure 19A:
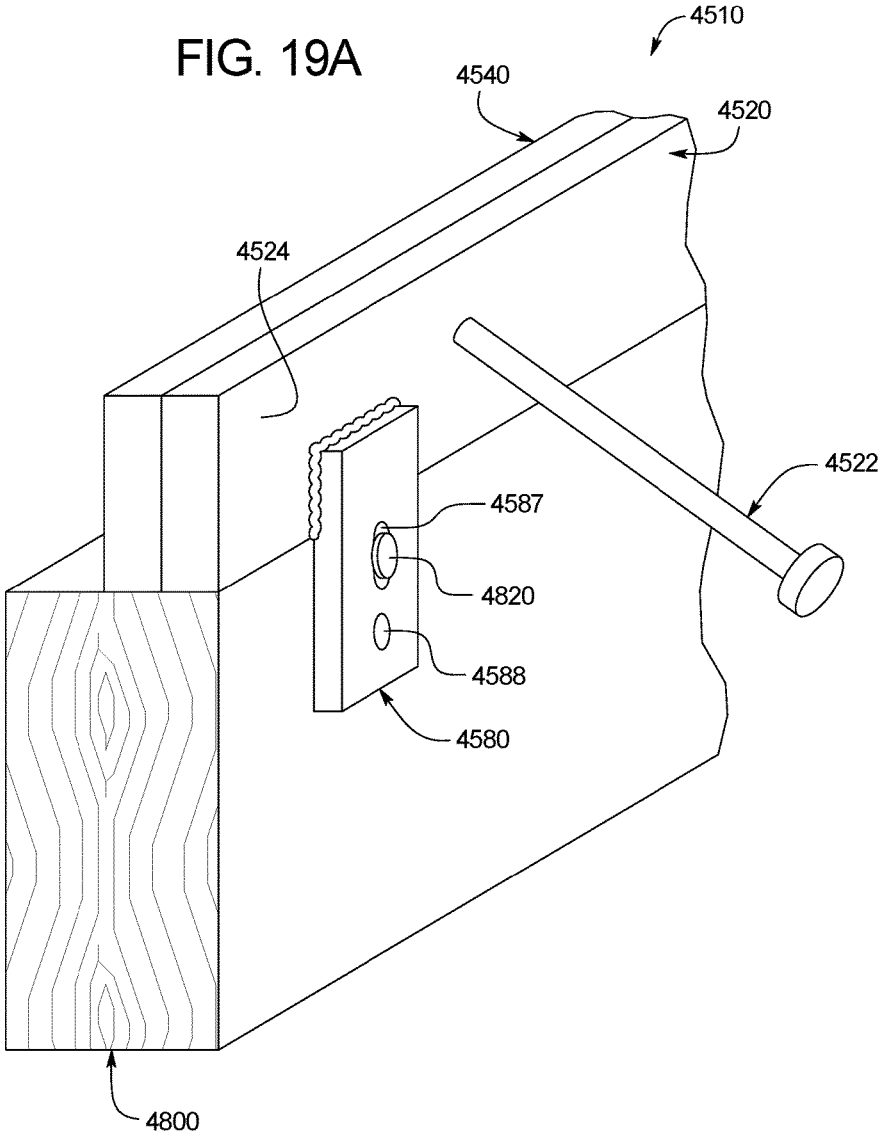
FIG. 19A is an end fragmentary perspective view of the joint edge assembly of FIG. 17 shown mounted on a formwork prior to height adjustment of the joint edge assembly.
Figure 19B:
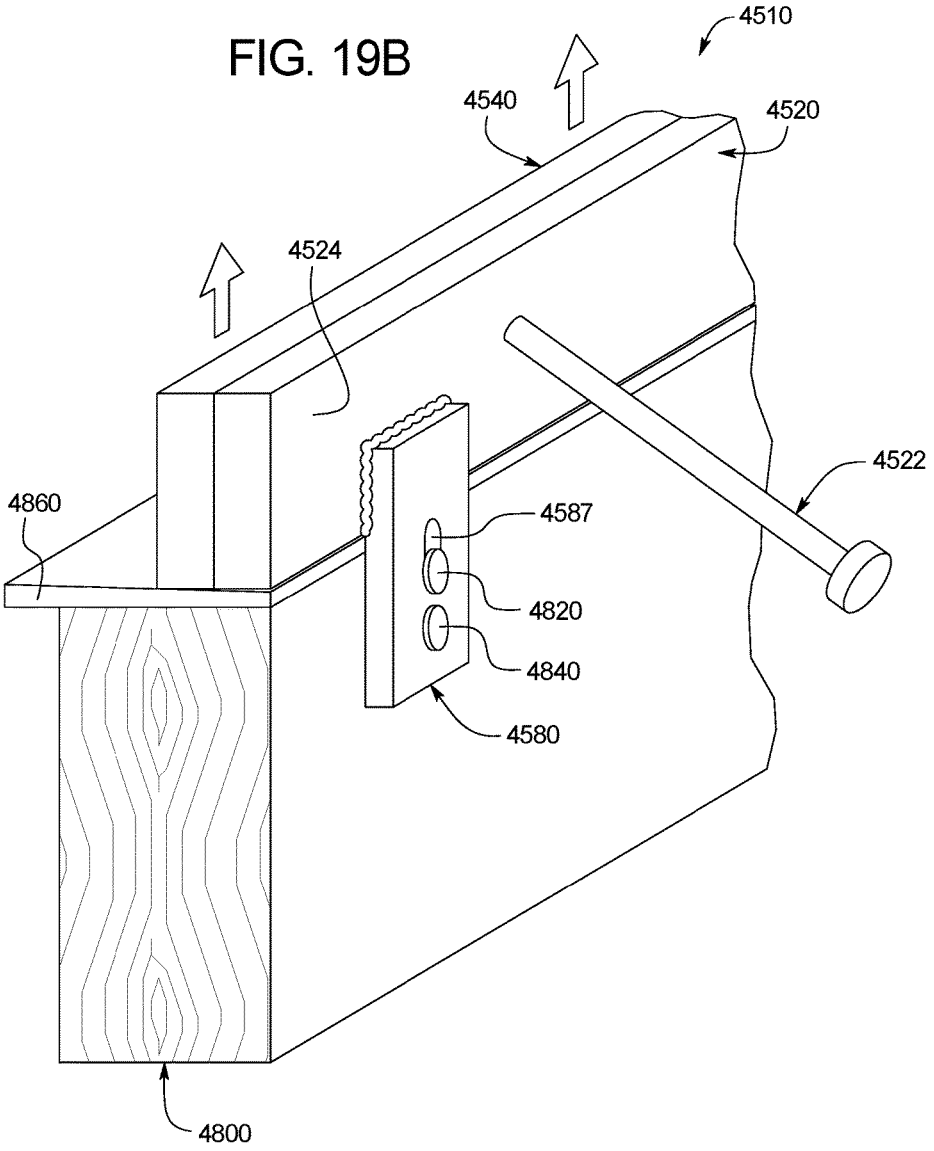
FIG. 19B is an end fragmentary perspective view of the joint edge assembly of FIG. 17 shown mounted on a formwork after height adjustment of the joint edge assembly.
Figure 20A:
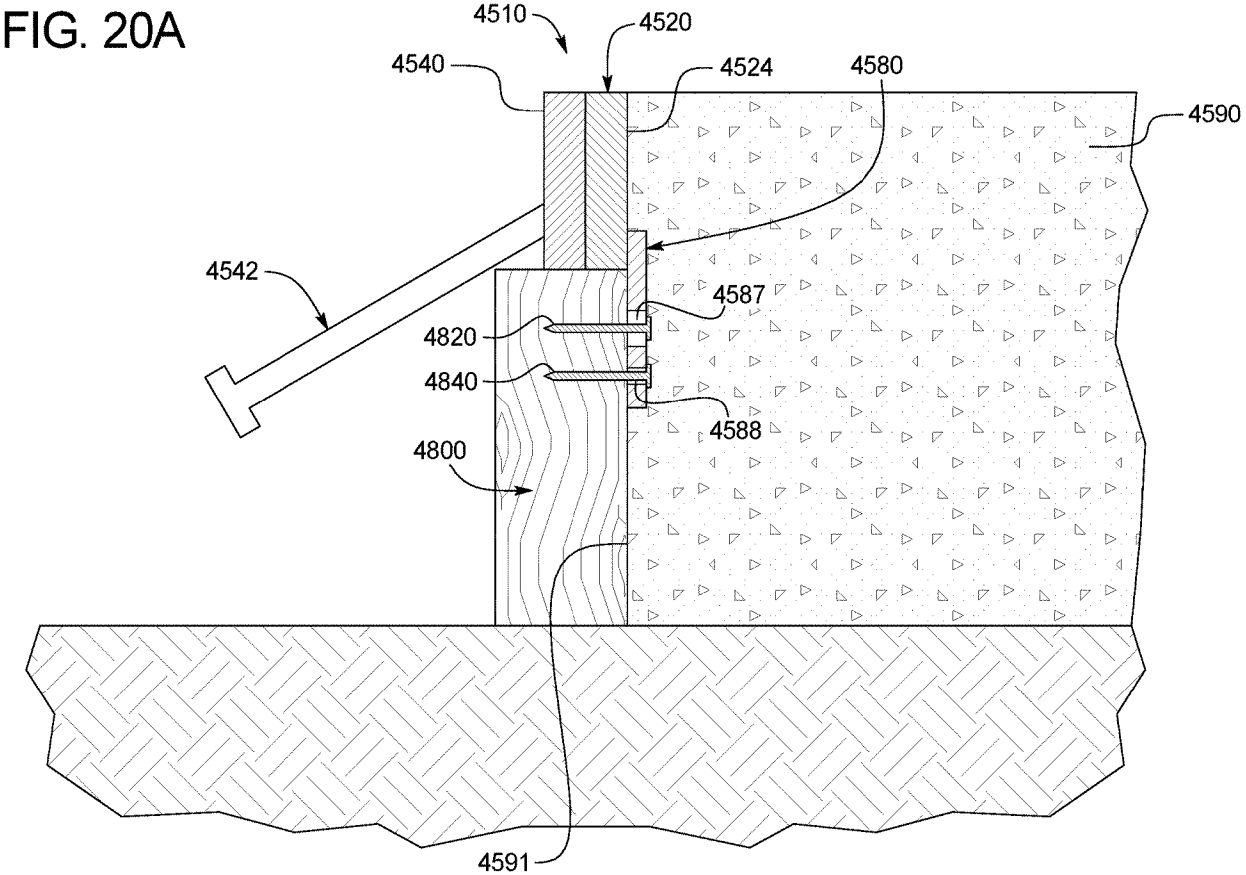
FIG. 20A is a partial cross-sectional view of the joint edge assembly of FIG. 19A shown mounted on formwork and after one of the concrete slabs is poured.
Figure 20B:
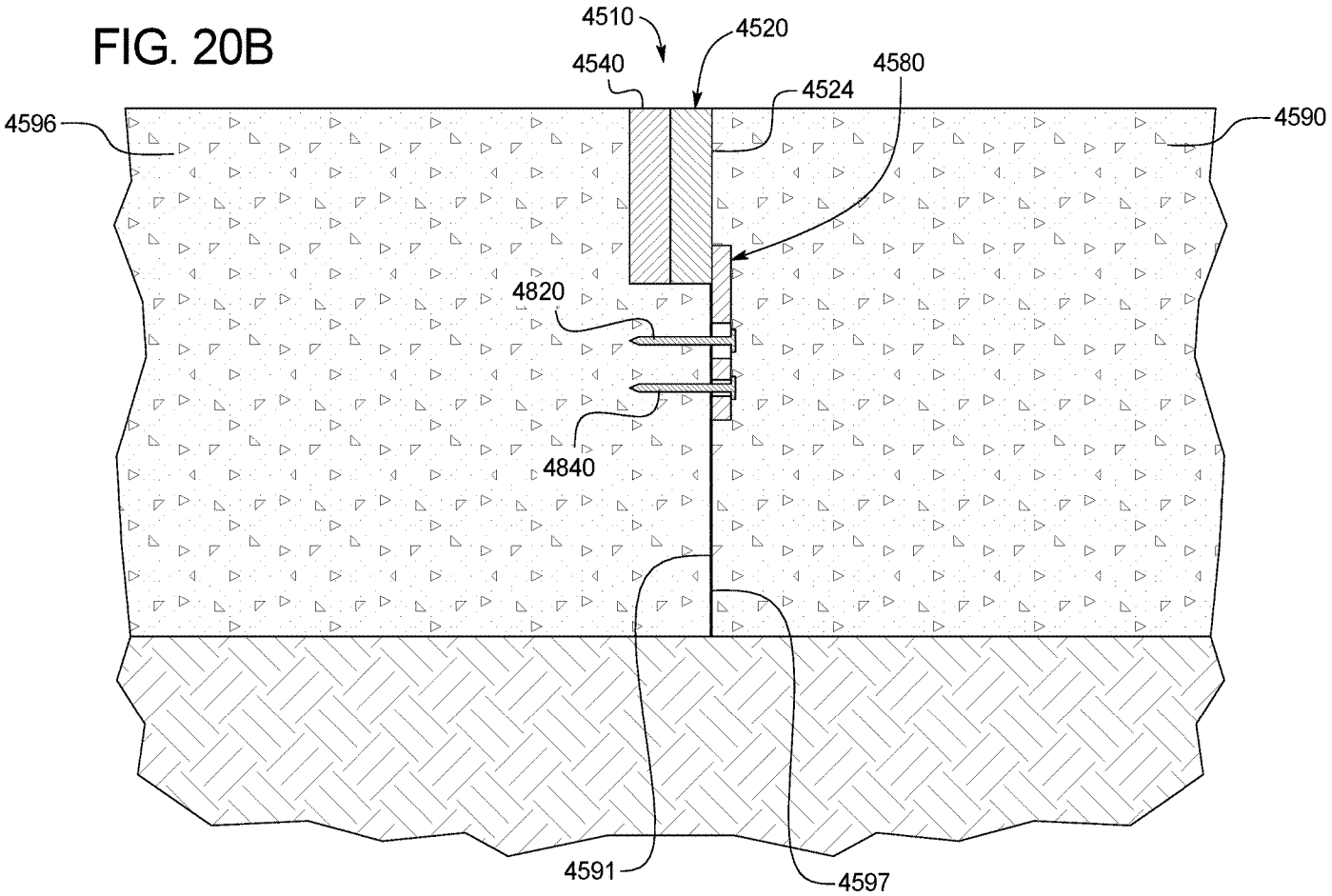
FIG. 20B is a partial cross-sectional view of the joint edge assembly of FIG. 19A shown after both of the concrete slabs are poured, and showing the position of the joint edge assembly relative to the concrete slabs.

Referring now to FIGS. 15 and 16, another example embodiment of the method of the present disclosure is shown. In this embodiment, the joint edge assembly 3510 generally includes: (1) an elongated longitudinal joint rail having a first elongated joint edge member 3520 and a second elongated joint edge member 3540; (2) a plurality of connectors (not shown) which connect the first and second elongated joint edge members 3520 and 3540 along their lengths during installation; (3) a first plurality or set of anchors 3522 integrally connected to and extending outwardly and downwardly from the first elongated joint edge member 3520; and (4) a second plurality or set of anchors 3542 integrally connected to and extending outwardly and downwardly from the second elongated joint edge member 3540. More specifically, the first elongated joint edge member 3520 in this illustrated example embodiment includes an elongated body have an upper edge 3521, a lower edge 3523, a slab engagement side 3524, a joint member engagement side 3525, a first end edge (not shown), and a second end edge (not shown). Likewise, the second elongated joint edge member 3540 in this illustrated example embodiment includes an elongated body have an upper edge 3541, a lower edge 3543, a slab engagement side 3544, a joint member engagement side 3545, a first end edge (not shown), and a second end edge (not shown).

The elongated joint edge members are each made from steel in this example embodiment. It should be appreciated that the elongated joint edge members can be made from other suitable materials in accordance with the present disclosure. It should also be appreciated that the elongated joint edge members can be made having other suitable shapes and sizes in accordance with the present disclosure.

The connectors (not shown) connect the first and second elongated joint edge members 3520 and 3540 along their lengths during installation. The connectors are respectively extendable though holes drilled or otherwise formed in the elongated joint edge members at longitudinal intervals. In one embodiment, the connectors fit within the holes via an interference fit, and particularly are of a slightly larger diameter than the holes such that they fit in the holes is substantially tight manner. This substantially eliminates play in the two joint edge members 3520 and 3540. The connectors (not shown) enable the elongated joint edge members to self-release under the force of the concrete slabs 3590 and 3596 shrinking during hardening.

The connectors are made from a plastic such as nylon in this example embodiment. It should be appreciated that the connectors can be made from other suitable materials and in other suitable manners in accordance with the present disclosure. The material of the connectors can be suitably chosen according to the design tensile strength of the concrete such that the connectors yield under the shrinkage stress of the concrete slabs 3590 and 3596. The tensile strength can also be variable according to the conditions and application of the concrete slabs. As the concrete slabs 3590 and 3596 shrink, the anchors 3522 and 2542 which are respectively embedded in the concrete slabs 3590 and 3596 pull the elongated joint edge members 3520 and 3540 apart. It should also be appreciated that the connectors can be made having other suitable shapes and sizes in accordance with the present disclosure. It should further be appreciated that the quantity and/or positioning of connectors can vary in accordance with the present disclosure. It should further be appreciated that in various embodiments, the joint edge assembly does not include such connectors in accordance with the present disclosure but rather includes another suitable mechanism for maintaining the first and second elongated joint edge members together during installation.

The first plurality or set of anchors 3522 are integrally connected to and extend outwardly and downwardly from the slab engaging side 3524 of the first elongated joint edge member 3520. After the first elongated joint edge member 3520 is installed, each anchor 3522 extends into the region where the concrete of the first slab 3590 is to be poured such that, upon hardening of the first concrete slab 3590, the anchors 3522 are cast within the body of the first concrete slab 3590. The anchors 3522 are made from steel and welded to the slab engagement side 3524 of the first elongated joint edge member 3520 in this example embodiment. It should be appreciated that the anchors 3522 can be made from other suitable materials and attached to the elongated joint edge member 3520 in other suitable manners in accordance with the present disclosure. It should also be appreciated that the anchors can be made having other suitable shapes and sizes in accordance with the present disclosure. It should further be appreciated that the quantity and/or positioning of anchors can vary in accordance with the present disclosure.

The second plurality or set of anchors 3542 are integrally connected to and extend outwardly and downwardly from the slab engaging side 3544 of the second elongated joint edge member 3540. After the second elongated joint edge member 3540 is installed, each anchor 3542 extends into the region where the concrete of the second slab 3596 is to be poured such that, upon hardening of the second concrete slab 3596, the anchors 3542 are cast within the body of the second concrete slab 3596. The anchors 3542 are made from steel and welded to the slab engagement side 3544 of the second elongated joint edge member 3540 in this example embodiment. It should be appreciated that the anchors can be made from other suitable materials and attached to the elongated joint edge member in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

In this embodiment, the method of the present disclosure includes positioning this joint edge assembly 3510 in an offset position from where the joint will be formed before either of the two adjacent concrete slabs are poured, and specifically includes using temporary formwork (not shown) to position the elongated joint edge members 3520 and 3540 such that they are oriented adjacent to the length of the joint between the adjacent concrete slabs, and parallel to the ground surface which defines a generally flat reference plane. More specifically, the method includes configuring the temporary formwork (not shown) such that: (1) the slab engagement surface 3544 of the second joint edge member 3540 extends in a first vertical or substantially vertical plane directly adjacent to the vertically extending plane in which the vertically extending side or end surface 3597 of the second concrete slab 3596 will lie such that the slab engagement surface 3544 of the second joint edge member 3540 will engage the vertically extending side or end surface 3597 of the second concrete slab 3596 after the second concrete slab 3596 is poured; (2) the opposite or first slab facing side 3545 of the second joint edge member 3540 extends in a second vertical or substantially vertical plane inwardly (relative to the first concrete slab 3590) of the vertical plane in which the vertically extending side or end surface 3591 of the first concrete slab 3590 will lie after the first concrete slab 3590 is poured; (3) the second slab facing side 3525 of the first joint edge member 3520 extends in a third vertical or substantially vertical plane further inwardly (relative to the first concrete slab 3590) of the vertical plane in which the vertically extending side or end surface 3591 of the first concrete slab 3590 will lie after the first concrete slab 3590 is poured; and (4) the slab engagement surface 3524 of the first joint edge member 3520 extends in a vertical or substantially vertical plane even further inwardly (relative to the first concrete slab 3520) of the vertical plane in which the vertically extending side or end surface 3591 of the first concrete slab 3590 will lie after the first concrete slab 3590 is poured. As the concrete slabs shrink and separate from one another, the first and second elongated members prevent filler from leaking into the lower substantial portion of the joint, and do not require the elongated joint edge members to be made wider, heavier, or more costly. In the method of this embodiment, the first concrete slab is poured and then the second concrete slab is poured. In an alternative method of the present disclosure, the second concrete slab is poured and then the first concrete slab is poured.

Referring now to FIGS. 17, 18, 19A, 19B, 20A, and 20B, another example embodiment of the joint edge assembly and method of the present disclosure is shown. In this embodiment, the joint edge assembly 4510 generally includes: (1) an elongated longitudinal joint rail having a first elongated joint edge member 4520 and a second elongated joint edge member 4540; (2) a plurality of connectors 4555 which connect the first and second elongated joint edge members 4520 and 4540 along their lengths during installation; (3) a first plurality or set of anchors 4522 integrally connected to and extending outwardly and downwardly from the first elongated joint edge member 4520; (4) a second plurality or set of anchors 4542 integrally connected to and extending outwardly and downwardly from the second elongated joint edge member 4540; and (5) a plurality of height adjusters 4580 fixed to the slab engagement surface 4524 of the first joint edge member 4520.

More specifically, the first elongated joint edge member 4520 in this illustrated example embodiment includes an elongated body having an upper edge 4521, a lower edge 4523, a slab engagement side 4524, a joint member engagement side 4525, a first end edge 4526, and a second end edge 4527.

Likewise, the second elongated joint edge member 4540 in this illustrated example embodiment includes an elongated body have an upper edge 4541, a lower edge 4543, a slab engagement side 4544, a joint member engagement side 4545, a first end edge 4546, and a second end edge 4547.

The elongated joint edge members are each made from steel in this example embodiment. It should be appreciated that the elongated joint edge members can be made from other suitable materials in accordance with the present disclosure. It should also be appreciated that the elongated joint edge members can be made having other suitable shapes and sizes in accordance with the present disclosure.

The plurality of connectors 4555 connect the first and second elongated joint edge members 4520 and 4540 along their lengths during installation. The connectors 4555 are respectively extendable though holes drilled or otherwise formed in the elongated joint edge members at longitudinal intervals. In one embodiment, the connectors fit within the holes via an interference fit, and particularly are of a slightly larger diameter than the holes such that they fit in the holes is substantially tight manner. This substantially eliminates play in the two joint edge members 4520 and 4540. The connectors 4555 enable the elongated joint edge members to self-release under the force of the concrete slabs 4590 and 4596 shrinking during hardening.

The connectors are made from a plastic such as nylon in this example embodiment. It should be appreciated that the connectors can be made from other suitable materials and in other suitable manners in accordance with the present disclosure. The material of the connectors can be suitably chosen according to the design tensile strength of the concrete such that the connectors yield under the shrinkage stress of the concrete slabs 4590 and 4596. The tensile strength can also be variable according to the conditions and application of the concrete slabs. As the concrete slabs 4590 and 4596 shrink, the anchors 4522 and 4542 which are respectively embedded in the concrete slabs 4590 and 4596 pull the elongated joint edge members 4520 and 4540 apart. It should also be appreciated that the connectors can be made having other suitable shapes and sizes in accordance with the present disclosure. It should further be appreciated that the quantity and/or positioning of connectors can vary in accordance with the present disclosure. It should further be appreciated that in various embodiments, the joint edge assembly does not include such connectors in accordance with the present disclosure but rather includes another suitable mechanism for maintaining the first and second elongated joint edge members together during installation.

The first plurality or set of anchors 4522 are integrally connected to and extend outwardly and downwardly from the slab engaging side 4524 of the first elongated joint edge member 4520. After the first elongated joint edge member 4520 is installed, each anchor 4522 extends into the region where the concrete of the first slab 4590 is to be poured such that, upon hardening of the first concrete slab 4590, the anchors 4522 are cast within the body of the first concrete slab 4590. The anchors 4522 are made from steel and welded to the slab engagement side 4524 of the first elongated joint edge member 4520 in this example embodiment. It should be appreciated that the anchors 4522 can be made from other suitable materials and attached to the elongated joint edge member 4520 in other suitable manners in accordance with the present disclosure. It should also be appreciated that the anchors can be made having other suitable shapes and sizes in accordance with the present disclosure. It should further be appreciated that the quantity and/or positioning of anchors can vary in accordance with the present disclosure.

The second plurality or set of anchors 4542 are integrally connected to and extend outwardly and downwardly from the slab engaging side 4544 of the second elongated joint edge member 4540. After the second elongated joint edge member 4540 is installed, each anchor 4542 extends into the region where the concrete of the second slab 4596 is to be poured such that, upon hardening of the second concrete slab 4596, the anchors 4542 are cast within the body of the second concrete slab 4596. The anchors 4542 are made from steel and welded to the slab engagement side 4544 of the second elongated joint edge member 4540 in this example embodiment. It should be appreciated that the anchors can be made from other suitable materials and attached to the elongated joint edge member in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

The plurality of height adjusters 4580 are fixed to the slab engagement surface 4524 of the first joint edge member 4520. The height adjusters 4580 are made from steel and welded at spaced apart locations to the slab engagement side surface 4524 of the elongated joint edge member 4520 in this example embodiment. It should be appreciated that the height adjusters can be made from other suitable materials, in other suitable shapes, and attached to the elongated joint edge member 4520 in other suitable manners in accordance with the present disclosure. It should further be appreciated that the quantity and/or positioning of height adjusters can vary in accordance with the present disclosure.

In this illustrated embodiment, each height adjuster 4580 includes a body having a slab facing side 4581, a joint edge member facing side 4582, a top edge 4583, a bottom edge 4584, a first side edge 4585, and a second side edge 4586. Each height adjuster 4580 in this illustrated embodiment defines a variable fastener opening such as oval slot 4587 and a non-variable fastener opening such as circular hole 4588. The upper end of the body of each the height adjuster 4580 is fixed by welding, for example, to the joint edge member 4520. The plurality of height adjusters enable the relative height of the first and second joint edge members 4520 and 4540 to be adjusted relative to the formwork below such first and second joint edge members 4520 and 4540.

In these embodiments, the method of the present disclosure includes positioning this joint edge assembly 4510 in an offset position from where the joint will be formed before either of the two adjacent concrete slabs 4590 and 4596 are poured, and specifically includes using temporary formwork such as formwork 4800 to position the elongated joint edge members 4520 and 4540 such that they are oriented adjacent to the length of the joint that will be formed between adjacent concrete slabs 4590 and 4596, and parallel to the ground surface which defines a generally flat reference plane.

More specifically, the method includes configuring the temporary formwork 4800 and the joint edge assembly 4510 such that: (1) the slab engagement surface 4524 of the first joint edge member 4520 extends in a first vertical or substantially vertical plane directly adjacent to the vertically extending plane in which the vertically extending side or end surface 4591 of the first concrete slab 4590 will lie such that the slab engagement surface 4524 of the first joint edge member 4520 will engage the vertically extending side or end surface 4591 of the first concrete slab 4590 after the first concrete slab 4590 is poured; (2) the opposite or second slab facing side 4525 of the first joint edge member extends in a second vertical or substantially vertical plane inwardly (relative to the second concrete slab) of the vertical plane in which the vertically extending side or end surface 4597 of the second concrete slab 4596 will lie after the second concrete slab 4596 is poured; (3) the first slab facing side 4545 of the second joint edge member 4540 extends in a third vertical or substantially vertical plane further inwardly (relative to the second concrete slab) of the vertical plane in which the vertically extending side or end surface 4597 of the second concrete slab 4596 will lie after the second concrete slab 4596 is poured; and (4) the slab engagement surface 4544 of the second joint edge member 4540 extends in a vertical or substantially vertical plane even further inwardly (relative to the second concrete slab) of the vertical plane in which the vertically extending side or end surface of the second concrete slab 4596 will lie after the second concrete slab 4596 is poured.

This method of the present disclosure further generally includes (a) positioning first formwork fasteners such as fastener 4820 through the variable openings 4587 in the respective height adjusters 4580 and into the formwork 4800 below the first and second joint edge members 4520 and 4540; (b) adjusting or setting the height of the first and second joint edge members 4520 and 4540 relative to the formwork 4800 and relative to the horizontal plane of the top surfaces of the first and second concrete slabs 4590 and 4596; (c) employing one or more shims such as shim 4860 to maintain the adjusted height of the joint edge assembly 4510; and (d) positioning second formwork fasteners such as fastener 4840 through the non-variable openings 4580 in the height adjusters 4580 and into the formwork 4800 below the first and second joint edge members 4520 and 4540 to fix the height of the first and second joint edge members 4520 and 4540 relative to the formwork 4800 and relative to the concrete slabs 4590 and 4596 to be poured. It should be appreciated that in alternative embodiments the shims such as shim 4860 used to maintain the adjusted height of the joint edge assembly 4510 are of different sizes and configurations. In one such alternative embodiment, the shim has a smaller horizontally extending width. In one such alternative embodiment, the shim has a smaller horizontally extending width that is equal or substantially equal to the combined width of elongated joint member 4520 and 4540.

The method includes pouring the first concrete slab 4590, allowing that slab to at least partially cure, removing the formwork 4800 and any shims 4860, and pouring the second concrete slab 4596. It should be appreciated that the variable openings in the height adjusters enable the height of the first and second joint edge members 4520 and 4540 to be adjusted after the first fasteners are attached to the formwork. It should further be appreciated that the fasteners 4820 and 4840 may remain in the concrete slabs in various embodiments of the method of the present disclosure.

Referring now to FIGS. 21, 22, 23, 24, and 25, another example embodiment of the joint edge assembly and method of the present disclosure is shown. In this embodiment, the joint edge assembly 5510 generally includes: (1) an elongated longitudinal joint rail having a first elongated joint edge member 5520 and a second elongated joint edge member 5540; (2) a plurality of connectors 5555 which connect the first and second elongated joint edge members 5520 and 5540 along their lengths during installation; (3) a first plurality or set of anchors 5522 integrally connected to and extending outwardly and downwardly from the first elongated joint edge member 5520; (4) a second plurality or set of anchors 5542 integrally connected to and extending outwardly and downwardly from the second elongated joint edge member 5540; (5) one or more vertically or substantially vertically extending height adjusters or height adjustor plates 5580 fixed to the slab engagement surface 5524 of the first joint edge member 5520; and (6) a horizontally or substantially horizontally extending metal plate 5180 fixed to the first elongated joint edge member 5520. In certain embodiments, the metal plate 5180 is also fixed to the one or more height adjusters 5580. In other embodiments, the metal plate 5180 is only fixed to the one or more height adjusters or height adjuster plates 5580.

More specifically, the first elongated joint edge member 5520 in this illustrated example embodiment includes an elongated body having an upper edge, a lower edge, a slab engagement side, a joint member engagement side, a first end edge, and a second end edge.

Likewise, the second elongated joint edge member 5540 in this illustrated example embodiment includes an elongated body have an upper edge, a lower edge, a slab engagement side, a joint member engagement side, a first end edge, and a second end edge.

The elongated joint edge members are each made from steel in this example embodiment. It should be appreciated that the elongated joint edge members can be made from other suitable materials in accordance with the present disclosure. It should also be appreciated that the elongated joint edge members can be made having other suitable shapes and sizes in accordance with the present disclosure.

The connectors 5555 connect the first and second elongated joint edge members 5520 and 5540 along their lengths during installation. The connectors 5555 are respectively extendable though holes drilled or otherwise formed in the elongated joint edge members at longitudinal intervals. In one embodiment, the connectors fit within the holes via an interference fit, and particularly are of a slightly larger diameter than the holes such that they fit in the holes is substantially tight manner. This substantially eliminates play in the two joint edge members 5520 and 5540. The connectors 5555 enable the elongated joint edge members to self-release under the force of the concrete slabs 5590 and 5596 shrinking during hardening and generally shown in FIG. 25.

The connectors are made from a plastic such as nylon in this example embodiment. It should be appreciated that the connectors can be made from other suitable materials and in other suitable manners in accordance with the present disclosure. The material of the connectors can be suitably chosen according to the design tensile strength of the concrete such that the connectors yield under the shrinkage stress of the concrete slabs 5590 and 5596. The tensile strength can also be variable according to the conditions and application of the concrete slabs. As the concrete slabs 5590 and 5596 shrink, the anchors 5522 and 5542 which are respectively embedded in the concrete slabs 5590 and 5596 pull the elongated joint edge members 5520 and 5540 apart and generally shown in FIG. 25. It should also be appreciated that the connectors can be made having other suitable shapes and sizes in accordance with the present disclosure. It should further be appreciated that the quantity and/or positioning of connectors can vary in accordance with the present disclosure. It should further be appreciated that in various embodiments, the joint edge assembly does not include such connectors in accordance with the present disclosure but rather includes another suitable mechanism for maintaining the first and second elongated joint edge members together during installation.

The first plurality or set of anchors 5522 are integrally connected to and extend outwardly and downwardly from the slab engaging side 5524 of the first elongated joint edge member 5520. After the first elongated joint edge member 5520 is installed, each anchor 5522 extends into the region where the concrete of the first slab 5590 is to be poured such that, upon hardening of the first concrete slab 5590, the anchors 5522 are cast within the body of the first concrete slab 5590. The anchors 5522 are made from steel and welded to the slab engagement side 5524 of the first elongated joint edge member 5520 in this example embodiment. It should be appreciated that the anchors 5522 can be made from other suitable materials and attached to the elongated joint edge member 5520 in other suitable manners in accordance with the present disclosure. It should also be appreciated that the anchors can be made having other suitable shapes and sizes in accordance with the present disclosure. It should further be appreciated that the quantity and/or positioning of anchors can vary in accordance with the present disclosure.

The second plurality or set of anchors 5542 are integrally connected to and extend outwardly and downwardly from the slab engaging side 5544 of the second elongated joint edge member 5540. After the second elongated joint edge member 5540 is installed, each anchor 5542 extends into the region where the concrete of the second slab 5596 is to be poured such that, upon hardening of the second concrete slab 5596, the anchors 5542 are cast within the body of the second concrete slab 5596. The anchors 5542 are made from steel and welded to the slab engagement side 5544 of the second elongated joint edge member 5540 in this example embodiment. It should be appreciated that the anchors can be made from other suitable materials and attached to the elongated joint edge member in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

Each height adjuster or height adjuster plate 5580 is fixed to the slab engagement surface 5524 of the first joint edge member 5520. Each height adjuster or height adjuster plate 5580 is made from steel and welded to the slab engagement side surface 5524 of the elongated joint edge member 5520 in this example embodiment. It should be appreciated that each height adjuster can be made from other suitable materials, in other suitable shapes, and attached to the elongated joint edge member 5520 in other suitable manners in accordance with the present disclosure. It should further be appreciated that the quantity and/or positioning of each height adjuster can vary in accordance with the present disclosure.

In this illustrated embodiment, each height adjuster or height adjuster plate 5580 includes a vertically extending body having a slab facing side 5581, a joint edge member facing side 5582, a top edge 5583, a bottom edge 5584, a first side edge, and a second side edge. Each height adjuster or height adjuster plate 5580 in this illustrated example embodiment defines a variable fastener opening such as an oval slot (not shown) and a non-variable fastener opening such as circular hole (not shown). The upper end of the body of each the height adjuster height adjuster plate 5580 is fixed by welding, for example, to the joint edge member 5520. Each height adjuster or height adjuster plate enables the relative height of the first and second joint edge members 5520 and 5540 to be adjusted relative to the formwork below such first and second joint edge members 5520 and 5540. It should be appreciated that in this illustrated embodiment, the plate 5580 is substantially wider and substantially taller than the height adjusters 4580 in the above described embodiments.

In alternative embodiments of the present disclosure, the plate 5580 does not include height adjustment features, and rather is attachable to formwork (such as wooden bar 5820) at different heights to facilitate height adjustment of the first and second joint edge members 5520 and 5540.

In this illustrated embodiment, the metal plate 5180 includes a horizontally extending body having an upper side 5182, a lower side 5183, a first side edge 5184, and a second side edge 5185. The upper side 5182 of the upper plate is fixed by welding, for example, to the bottom of the joint edge member 5520. In other embodiments, the first side edge 5184 is fixed by welding, for example, to the inner side of each height adjuster or height adjuster plate 5580. In other embodiments, the metal plate 5180 is fixed to both the joint edge member 5520 and the height adjuster(s).

In these embodiments, the method of the present disclosure includes positioning this joint edge assembly 5510 in an offset position from where the joint will be formed before either of the two adjacent concrete slabs 5590 and 5596 are poured, and specifically includes using temporary formwork such as formwork 5800 to position the elongated joint edge members 5520 and 5540 such that they are oriented adjacent to the length of the joint that will be formed between adjacent concrete slabs 5590 and 5596, and parallel to the ground surface which defines a generally flat reference plane.

In this illustrated embodiment, the formwork includes an elongated horizontally extending wooden bar or stud 5820 and a plurality of metal positioning stakes 5840 suitably attached to the wooden bar or stud 5820 by suitable fasteners. This formwork is reusable in various embodiments.

Figure 21:
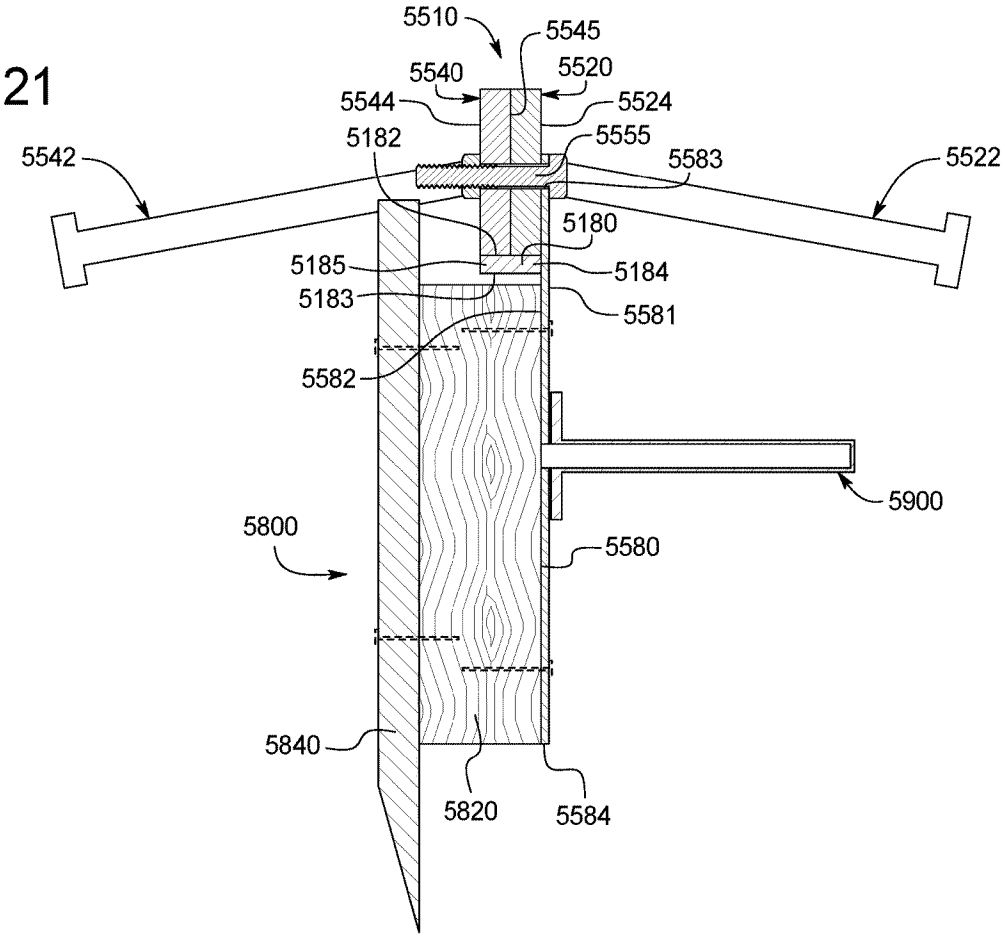
FIG. 21 is a partial cross-sectional view of another embodiment of the joint edge assembly of the present disclosure.

More specifically, as generally shown in FIG. 21, the method includes configuring and positioning the joined temporary formwork 5800 and the joint edge assembly 5510 such that: (1) the slab engagement surface 5524 of the first joint edge member 5520 extends in a first vertical or substantially vertical plane directly adjacent to the vertically extending plane in which the vertically extending side or end surface 5591 of the first concrete slab 5590 will lie such that the slab engagement surface 5524 of the first joint edge member 5520 will engage the vertically extending side or end surface 5591 of the first concrete slab 5590 after the first concrete slab 5590 is poured; (2) the opposite or second slab facing side 5525 of the first joint edge member extends in a second vertical or substantially vertical plane inwardly (relative to the second concrete slab) of the vertical plane in which the vertically extending side or end surface 5597 of the second concrete slab 5596 will lie after the second concrete slab 5596 is poured; (3) the first slab facing side 5545 of the second joint edge member 5540 extends in a third vertical or substantially vertical plane further inwardly (relative to the second concrete slab) of the vertical plane in which the vertically extending side or end surface 5597 of the second concrete slab 5596 will lie after the second concrete slab 5596 is poured; and (4) the slab engagement surface 5544 of the second joint edge member 5540 extends in a vertical or substantially vertical plane even further inwardly (relative to the second concrete slab) of the vertical plane in which the vertically extending side or end surface of the second concrete slab 5596 will lie after the second concrete slab 5596 is poured. This step includes inserting the positioning stakes 5840 into the ground surface (as shown in FIG. 22).

Figure 22:
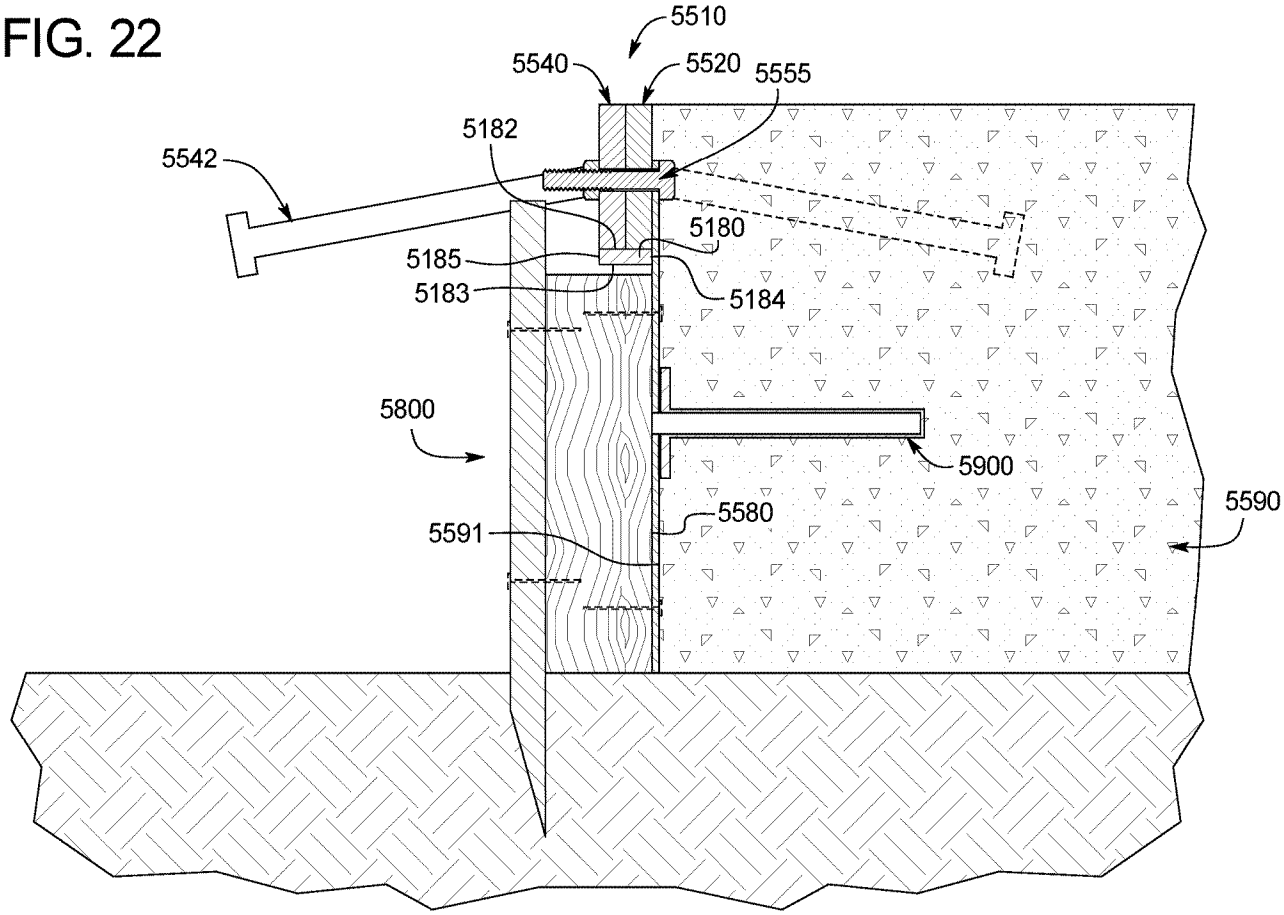
FIG. 22 is a partial cross-sectional view of the joint edge assembly of FIG. 21 shown mounted on formwork and after one of the concrete slabs is poured.

As also shown in FIGS. 21 and 22, this step of the method of this these embodiments of the present disclosure further generally includes: (a) positioning first formwork fasteners through the variable openings in the respective height adjuster and into the formwork 5800 below the first and second joint edge members 5520 and 5540; (b) adjusting or setting the height of the first and second joint edge members 5520 and 5540 relative to the formwork 5800 and relative to the horizontal plane of the top surfaces of the first and second concrete slabs 5590 and 5596; (c) if necessary, employing one or more shims (not shown) to maintain the adjusted height of the joint edge assembly 5510; and (d) positioning second formwork fasteners through the non-variable openings in the height adjuster and into the formwork 5800 below the first and second joint edge members 5520 and 5540 to fix the height of the first and second joint edge members 5520 and 5540 relative to the formwork 5800 and relative to the concrete slabs 5590 and 5596 to be poured. Alternatively, if the height adjuster plate does not include height adjustment features, the method of the present disclosure provides for the height adjustment by the attachment of the plate to the formwork.

Figure 23:
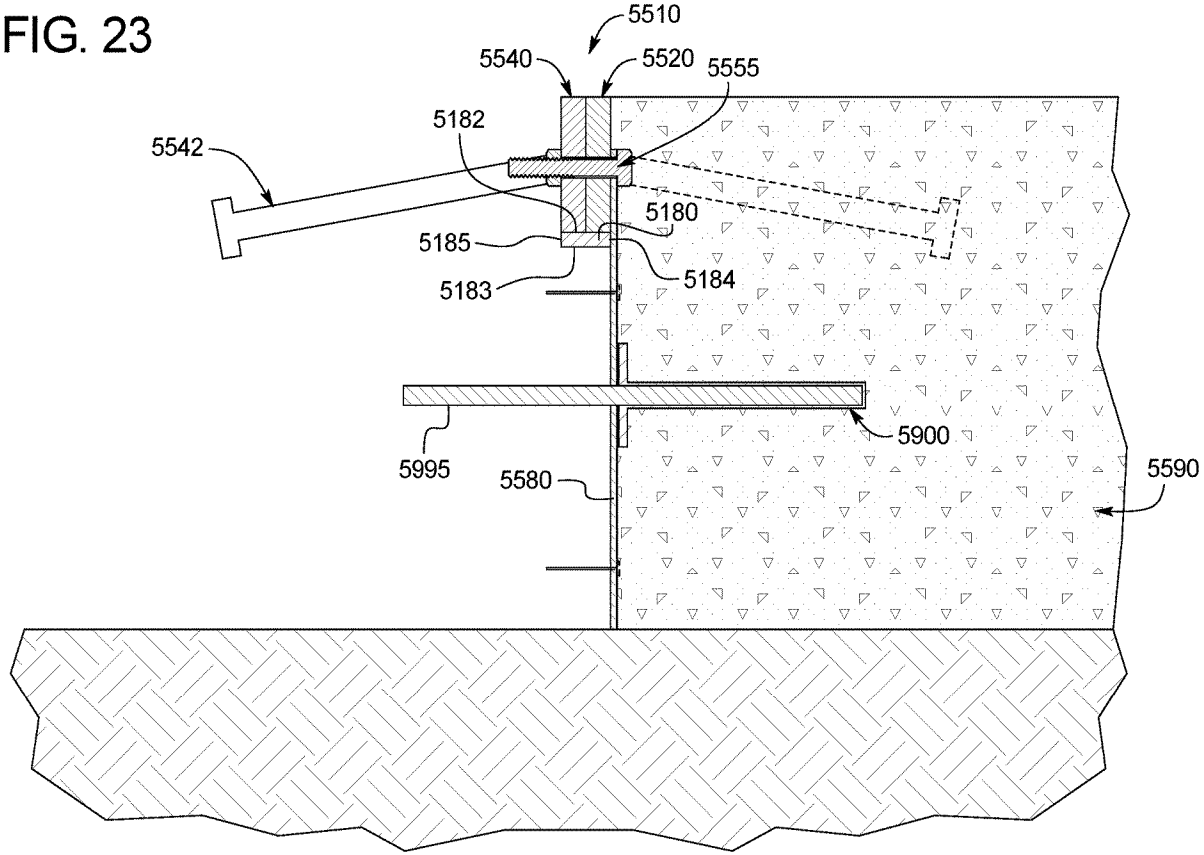
FIG. 23 is a partial cross-sectional view of the joint edge assembly of FIG. 21 shown after one of the concrete slabs is poured and after the formwork has been removed.
Figure 24:
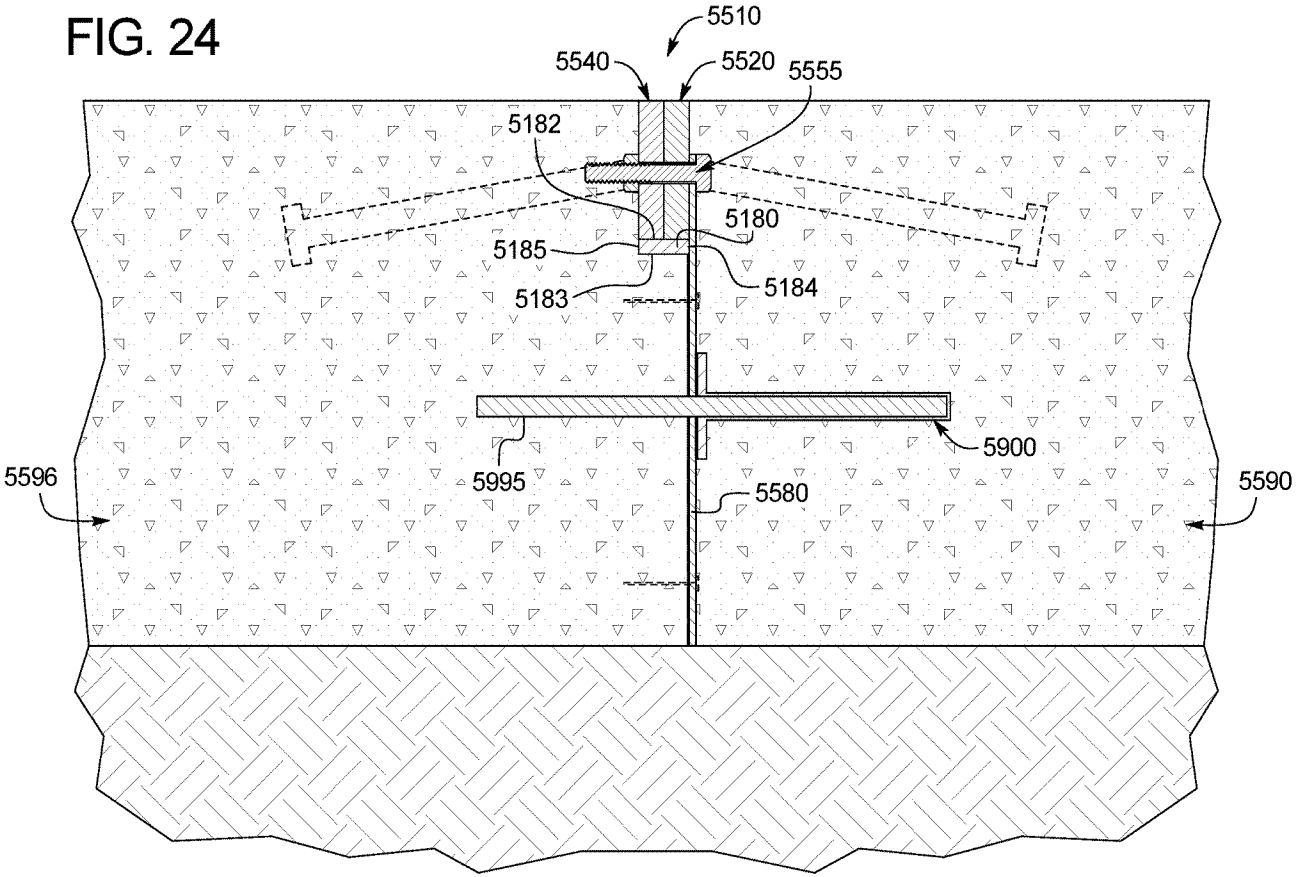
FIG. 24 is a partial cross-sectional view of the joint edge assembly of FIG. 21 shown after both of the concrete slabs are poured, and showing the position of the joint edge assembly relative to the concrete slabs.

The method then includes pouring the first concrete slab 5590 as generally shown in FIG. 22, allowing that slab to at least partially cure, removing the formwork 5800 and any shims used as generally shown in FIG. 23, inserting the dowel 5995 in the dowel pocket 5900 as generally shown in FIG. 23, and pouring the second concrete slab 5596 as generally shown in FIG. 24, and allowing the second concrete slab 5596 to cure.

It should be appreciated that the variable openings in the height adjusters, if provided, enable the height of the first and second joint edge members 5520 and 5540 to be adjusted after the first fasteners are attached to the formwork. It should further be appreciated that certain of the fasteners may remain in the concrete slabs in various embodiments of the method of the present disclosure.

It should be appreciated that the dowel pocket 5900 can be a dowel pocket currently sold by the assignee of this patent application under the trademark DIAMOND DOWEL. It should further be appreciated that the dowel 5995 can be a dowel currently sold by the assignee of this patent application under the trademark DIAMOND DOWEL. It should be appreciated that the dowel pocket 5900 is suitably attached to the plate 5580 prior to pouring of the slab 5590.

Figure 25:
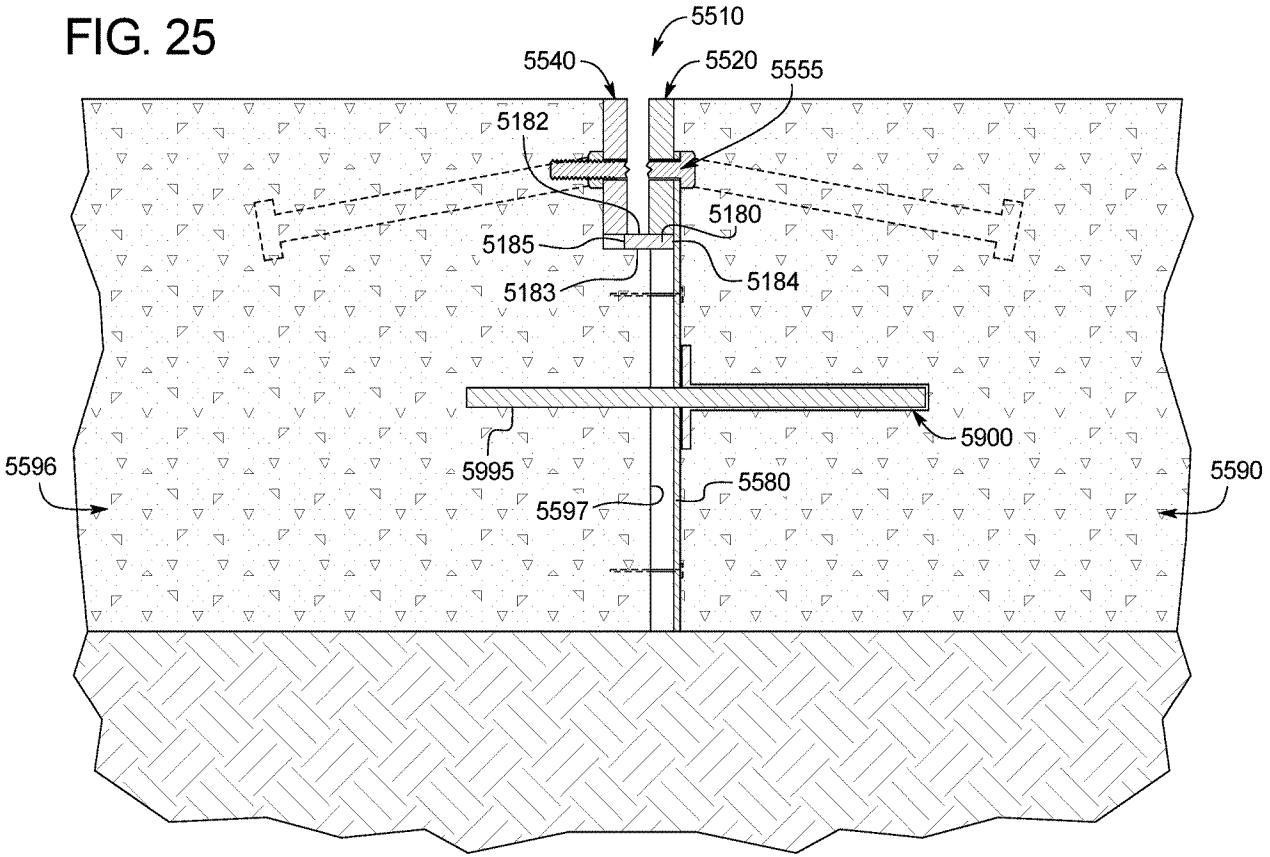
FIG. 25 is a partial cross-sectional view of the joint edge assembly of FIG. 21 shown after both of the concrete slabs are poured, have cured, and have separated to a certain extent.

In this illustrated example embodiment as shown in FIG. 25, the metal plate 5180, each height adjuster or height adjuster plate 5580, and the offset position of the joint edge member 5520 allow for or provide for a wider gap or separation between the joint edge member 5520 and the joint edge member 5540.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A concrete slab joint assembly for forming a joint between a first concrete slab and a second concrete slab, said joint edge assembly comprising:

a first elongated joint edge member;

a plurality of first anchors integrally connected to extending outwardly and downwardly from the first elongated joint edge member and configured to extend into the first concrete slab;

a plurality of height adjusters fixedly attached to the first elongated joint edge member at spaced apart positions;

a second elongated joint edge member; and a plurality of second anchors integrally connected to extending outwardly and downwardly from the second elongated joint edge member and configured to extend into the second concrete slab, wherein the first elongated joint edge member includes an elongated body having an upper edge, a lower edge, a slab engagement side, a joint member engagement side, a first end edge, and a second end edge, and wherein the plurality of height adjusters are integrally fixed to the slab engagement side of the first elongated joint edge member.

2. The concrete slab joint assembly of claim 1, wherein the first elongated joint edge member, the plurality of first anchors, the plurality of height adjusters, the second elongated joint edge member, and the plurality of second anchors are configured such that:

(i) a slab engagement surface of the first joint edge member will extend in a first vertical or substantially vertical plane directly adjacent to a vertically extending plane in which a vertically extending side or end surface of the first concrete slab will lie such that the slab engagement surface of the first joint edge member will be adjacent to the vertically extending side or end surface of the first concrete slab after the first concrete slab is poured, (ii) the slab engagement surface of the first joint edge member will extend in the first vertical or substantially vertical plane outward relative to any vertically extending plane in which any vertically extending side or end surface of the first concrete slab will lie after the first concrete slab is poured, (iii) a second slab facing side of the first joint edge member will extend in a second vertical or substantially vertical plane inwardly relative to a vertical or substantially vertical plane of the second concrete slab in which a vertically extending side or end surface of the second concrete slab will lie after the second concrete slab is poured;

(iv) a first slab facing side of the second joint edge member will extend in a third vertical or substantially vertical plane further inwardly relative to the vertical or substantially vertical plane of the second concrete slab in which the vertically extending side or end surface of the second concrete slab will lie after the second concrete slab is poured, and (v) a slab engagement surface of the second joint edge member will extend in a fourth vertical or substantially vertical plane even further inwardly relative to the vertical or substantially vertical plane of the second concrete slab in which the vertically extending side or end surface of the second concrete slab will lie after the second concrete slab is poured.

3. The concrete slab joint assembly of claim 1, which includes a plurality of connectors connecting the first and second elongated joint edge members along their lengths.

4. The concrete slab joint assembly of claim 1, wherein one of the height adjusters defines a variable opening and a non-variable opening.

5. The concrete slab joint assembly of claim 4, wherein the variable fastener opening is oval and the non-variable fastener opening is circular.

6. The concrete slab joint assembly of claim 1, wherein each of a plurality of the height adjusters defines a variable opening and a non-variable opening.

7. The concrete slab joint assembly of claim 6, wherein the variable fastener openings are oval and the non-variable fastener openings are circular.

8. The concrete slab joint assembly of claim 6, wherein the height adjusters are configured to enable: (a) positioning first formwork fasteners through the variable openings in the height adjusters and into the formwork below the first and second joint edge members, (b) setting a height of the first and second joint edge members relative to the formwork below the first and second joint edge members, and (c) positioning second formwork fasteners through the non-variable openings in the height adjusters and into the formwork below the first and second joint edge members to fix the height of the first and second joint edge members relative to the formwork below the first and second joint edge members.

9. The concrete slab joint assembly of claim 1, which includes a plurality of dowel pockets attached to the plurality of height adjustors.

10. The concrete slab joint assembly of claim 1, which includes a horizontally or substantially horizontally extending metal plate fixed to the first elongated joint edge member.

11. The concrete slab joint assembly of claim 1, wherein the first joint member is steel, the plurality of height adjusters are steel, and the plurality of height adjusters are welded at spaced apart locations to the slab engagement side surface of the elongated joint edge member.

12. The concrete slab joint assembly of claim 1, wherein each height adjuster includes a body having a slab facing side, a joint edge member facing side that is fixed to the slab engagement side of the first joint member, a top edge, a bottom edge, a first side edge, and a second side edge.

13. A concrete slab joint assembly for forming a joint between a first concrete slab and a second concrete slab, said joint edge assembly comprising:

a first elongated joint edge member including an elongated body having an upper edge, a lower edge, a slab engagement side, a joint member engagement side, a first end edge, and a second end edge;

a plurality of first anchors integrally connected to extending outwardly and downwardly from the slab engagement side of the first elongated joint edge member and configured to extend into the first concrete slab;

a plurality of height adjusters fixedly attached to the slab engagement side of the first elongated joint edge member at spaced apart positions, each of the plurality of the height adjusters defining an oval variable opening and a circular non-variable opening;

a horizontally or substantially horizontally extending plate fixed to the lower edge of the first elongated joint edge member;

a second elongated joint edge member;

a plurality of second anchors integrally connected to extending outwardly and downwardly from the second elongated joint edge member and configured to extend into the second concrete slab; and a plurality of connectors connecting the first and second elongated joint edge members along their lengths.

14. The concrete slab joint assembly of claim 13, wherein the first elongated joint edge member, the plurality of first anchors, the plurality of height adjusters, the plate, the second elongated joint edge member, the plurality of second anchors, and the plurality of connectors are configured such that:

(i) a slab engagement surface of the first joint edge member will extend in a first vertical or substantially vertical plane directly adjacent to a vertically extending plane in which a vertically extending side or end surface of the first concrete slab will lie such that the slab engagement surface of the first joint edge member will be adjacent to the vertically extending side or end surface of the first concrete slab after the first concrete slab is poured, (ii) the slab engagement surface of the first joint edge member will extend in the first vertical or substantially vertical plane outward relative to any vertically extending plane in which any vertically extending side or end surface of the first concrete slab will lie after the first concrete slab is poured, (iii) a second slab facing side of the first joint edge member will extend in a second vertical or substantially vertical plane inwardly relative to a vertical or substantially vertical plane of the second concrete slab in which a vertically extending side or end surface of the second concrete slab will lie after the second concrete slab is poured;

(iv) a first slab facing side of the second joint edge member will extend in a third vertical or substantially vertical plane further inwardly relative to the vertical or substantially vertical plane of the second concrete slab in which the vertically extending side or end surface of the second concrete slab will lie after the second concrete slab is poured, and (v) a slab engagement surface of the second joint edge member will extend in a fourth vertical or substantially vertical plane even further inwardly relative to the vertical or substantially vertical plane of the second concrete slab in which the vertically extending side or end surface of the second concrete slab will lie after the second concrete slab is poured.

15. The concrete slab joint assembly of claim 14, wherein the height adjusters are configured to enable: (a) positioning first formwork fasteners through the variable openings in the height adjusters and into the formwork below the first and second joint edge members, (b) setting a height of the first and second joint edge members relative to the formwork below the first and second joint edge members, and (c) positioning second formwork fasteners through the non-variable openings in the height adjusters and into the formwork below the first and second joint edge members to fix the height of the first and second joint edge members relative to the formwork below the first and second joint edge members.

16. The concrete slab joint assembly of claim 13, which includes a plurality of dowel pockets attached to the plurality of height adjustors.

17. The concrete slab joint assembly of claim 13, wherein each height adjuster includes a body having a slab facing side, a joint edge member facing side that is fixed to the slab engagement side of the first joint member, a top edge, a bottom edge, a first side edge, and a second side edge.

18. A concrete slab joint assembly for forming a joint between a first concrete slab and a second concrete slab, said joint edge assembly comprising:

a first elongated joint edge member;

a plurality of first anchors integrally connected to extending outwardly and downwardly from the first elongated joint edge member and configured to extend into the first concrete slab;

a plurality of height adjusters fixedly attached to the first elongated joint edge member at spaced apart positions;

a second elongated joint edge member; and a plurality of second anchors integrally connected to extending outwardly and downwardly from the second elongated joint edge member and configured to extend into the second concrete slab, wherein the first elongated joint edge member, the plurality of first anchors, the plurality of height adjusters, the second elongated joint edge member, and the plurality of second anchors are configured such that:

(i) a slab engagement surface of the first joint edge member will extend in a first vertical or substantially vertical plane directly adjacent to a vertically extending plane in which a vertically extending side or end surface of the first concrete slab will lie such that the slab engagement surface of the first joint edge member will be adjacent to the vertically extending side or end surface of the first concrete slab after the first concrete slab is poured, (ii) the slab engagement surface of the first joint edge member will extend in the first vertical or substantially vertical plane outward relative to any vertically extending plane in which any vertically extending side or end surface of the first concrete slab will lie after the first concrete slab is poured, (iii) a second slab facing side of the first joint edge member will extend in a second vertical or substantially vertical plane inwardly relative to a vertical or substantially vertical plane of the second concrete slab in which a vertically extending side or end surface of the second concrete slab will lie after the second concrete slab is poured;

(iv) a first slab facing side of the second joint edge member will extend in a third vertical or substantially vertical plane further inwardly relative to the vertical or substantially vertical plane of the second concrete slab in which the vertically extending side or end surface of the second concrete slab will lie after the second concrete slab is poured, and (v) a slab engagement surface of the second joint edge member will extend in a fourth vertical or substantially vertical plane even further inwardly relative to the vertical or substantially vertical plane of the second concrete slab in which the vertically extending side or end surface of the second concrete slab will lie after the second concrete slab is poured.

19. The concrete slab joint assembly of claim 18, wherein one of the height adjusters defines a variable opening and a non-variable opening.

20. The concrete slab joint assembly of claim 18, wherein each of a plurality of the height adjusters defines a variable opening and a non-variable opening, and wherein the height adjusters are configured to enable: (a) positioning first formwork fasteners through the variable openings in the height adjusters and into the formwork below the first and second joint edge members, (b) setting a height of the first and second joint edge members relative to the formwork below the first and second joint edge members, and (c) positioning second formwork fasteners through the non-variable openings in the height adjusters and into the formwork below the first and second joint edge members to fix the height of the first and second joint edge members relative to the formwork below the first and second joint edge members.

* * * * *